US006547098B1

(12) United States Patent
Kaye

(10) Patent No.: US 6,547,098 B1
(45) Date of Patent: Apr. 15, 2003

(54) DECORATING AND CUTTING DEVICE WITH CUTTING DEVICE BLADE BIASING

(76) Inventor: Perry Kaye, 11008 Nashville Dr., Cooper City, FL (US) 33026

( * ) Notice: Subject to any disclaimer, the term of this patent is extended or adjusted under 35 U.S.C. 154(b) by 0 days.

(21) Appl. No.: 10/140,876

(22) Filed: May 9, 2002

Related U.S. Application Data

(63) Continuation-in-part of application No. 10/061,653, filed on Feb. 1, 2002.

(51) Int. Cl.[7] ..... B25F 1/04

(52) U.S. Cl. ..... 222/80; 222/191; 222/192; 7/158; 30/162; 30/286; 401/195

(58) Field of Search ..... 7/158, 160; 30/123–125, 30/162, 286, 335; 401/195; 222/80, 191, 192

(56) References Cited

U.S. PATENT DOCUMENTS

| | | | | |
|---|---|---|---|---|
| 2,828,855 A | * | 4/1958 | Mosch | 206/234 |
| 3,257,991 A | * | 6/1966 | Mosch | 401/29 |
| 3,706,106 A | | 12/1972 | Leopoldi | |
| 4,602,397 A | | 7/1986 | Chao | |
| 4,635,309 A | | 1/1987 | Larsen | |
| D289,368 S | | 4/1987 | Mann | |
| 5,557,818 A | | 9/1996 | Leon | |
| 6,244,773 B1 | | 6/2001 | Geremia-Nargi | |
| D450,086 S | | 11/2001 | Rosenbaum | |

* cited by examiner

*Primary Examiner*—J. Casimer Jacyna
(74) *Attorney, Agent, or Firm*—Locke Liddell & Sapp LLP

(57) ABSTRACT

A decorating and cutting device includes a housing. A cutting blade and decorating material dispenser are disposed within the housing and are operable to simultaneously or independently dispense decorating material and/or cut a target material. The cutting blade is biased within the housing to prevent unintentional operation.

10 Claims, 38 Drawing Sheets

DECORATING AND CUTTING DEVICE WITH CUTTING DEVICE BLADE BIASING

IN THE CROSS REFERENCE TO RELATED APPLICATIONS

This is a continuation-in-part of U.S. Ser. No. 10/061,653, field Feb. 1, 2002, and entitled "Decorating and Cutting Device" by the same inventor and claims benefit therefrom.

TECHNICAL FIELD OF THE INVENTION

The present invention relates generally to the field of decorating and cutting, and more particularly to a device which is operable to perform decorating and/or cutting functions either independently or simultaneously.

BACKGROUND OF THE INVENTION

In crafting and other tasks the operations of cutting and decorating are usually performed separately. This is why there are many different types of cutting tools and many different types of decorating tools.

Felt tip markers are able to efficiently, and for a low cost, provide their users with an ability to decorate items and material like cloth, paper, plastics, cardboard, wood and other porous and non-porous material. Felt tip markers have a felt nib that is connected to an ink or decorating material storage and transference system. The ink or decorating material is drawn from the storage system, usually by capillary or wicking action, and moistens the nib to allow the nib to transfer the ink or decorating material to a target material.

A major problem with markers involves the durability of the nib. When most markers are used their nibs begin to distort due to the pressure placed on them and the rapid reversal of forces caused by the changing direction of the drawing and writing process. As the marker is moved up and down, back and forth and to and fro the angle at which pressure is exerted, on the nib, is changed and this can weaken, warp and destroy the nib. To resolve or lessen this problem many markers are made with springs helping to absorb the pressure of using the markers and/or a tube like casing is used to support the nib.

Rubber stamps have the ability to transfer complex images quickly and in a repeatable fashion. Rubber stamps have been shaped into cylinders and when run across a material can create long repeating decorations.

Many cutting tools are available. They come in all shapes and sizes. Some use stationary blades, some use moving blades and some use blades that swivel to allow their cutting direction to be controlled. These devices can be used to create precision cuts, however, precision cutting using these devices, by its nature, is a tedious and difficult task. The task of cutting is extremely difficult when it must be coordinated with an existing design. The user not only needs to make sure all their cuts are done in a fashion that gives a pleasing appearance they too must work to make sure they cut close enough to the existing design so as to remove all surrounding non-design material while at the same time working to avoid removing any of the design.

Present technologies do not directly address the need to cooperatively decorate and cut either in a freeform fashion or when using a template. A need has thus arisen for a device that allows a user to cut, decorate and/or to cooperatively cut and decorate either independently or simultaneously with the same device.

A need has further arisen for a cutting device with the ability to prevent unintentional cutting.

SUMMARY OF THE INVENTION

A decorating and cutting device includes a housing. A cutting blade and decorating material dispenser are disposed within the housing and are operable to simultaneously or independently dispense decorating material and/or cut a target material. The cutting blade is biased to prevent unintentional operation.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DETAILED DESCRIPTION OF THE PREFERRED EMBODIMENTS

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
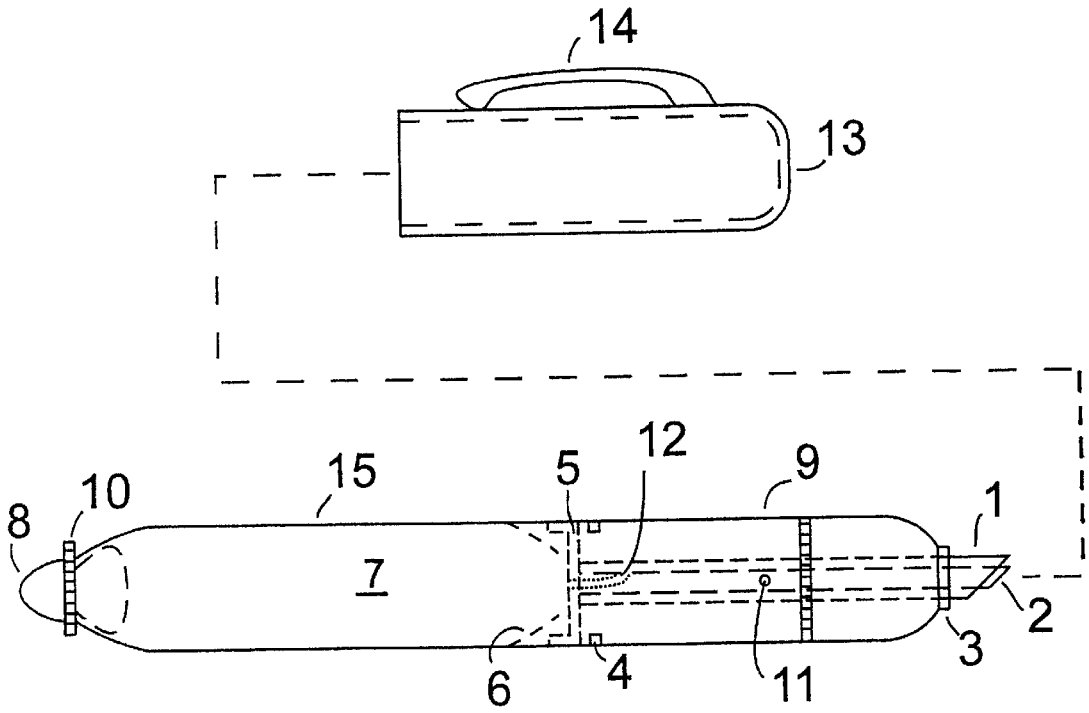
FIG. 1. is an exploded side view of the stationary spring tensioned cutting edge and decorating device of the present invention.

FIG. 1 shows an embodiment of the present invention that uses a stationary blade and decorating material dispenser or nib in a pen shaped device, which includes a cap and can be used as a normal marking device is used. The decorating material dispenser or nib 1 wicks ink, or other decorating material, from the decorating material storage reservoir 7, via the decorating material feed duct 12. The nib 1 is attached to the cutting assembly 2 and also at the cutting assembly base 5 using, for example, screws, tacks, adhesive, or pins 11 or simply a tight fit and a shape designed to discourage any pull-away forces. The decorating nib 1 and cutting assembly 2 are held in place by the cushion and retaining member 6 and the nib and cutting assembly stop blocks 4. The cutting assembly base 5 is tensioned in place by force from the cushion and retaining member 6. The cushion and retaining member 6 allows the cutting assembly 2 and nib 1 to be biased in a stationary position and also to give, flex and move slightly, when force is exerted during use. This will prolong blade and nib life and also protect them from shock. Member 6 also gives the device a softer feel and makes it easier to accommodate rough surfaces. The cushion and retaining member 6 also operates with a valve system. One embodiment has the valve attached to and working with the nib and cutter assembly base 5.

The decorating material reservoir 7 can simple be an empty reservoir or it can be filled with a material that is conducive to storing the decorating materials as anyone skilled in the art will know. The closing cap 8 keeps the decorating material sealed inside the main case 15.

Decorating material as used herein is any type of material that can be applied to a target material or surface for any useful purpose. Decorating material includes, for example, but is not limited to ink, dye, glue, lacquer, etching solution, oil, stain, colored wax, glitter and glue, colored glue, clear coat or any other material that might have some useful benefits. A target material includes, for example, paper, cloth, leather, cardboard and the like, or any other material that might receive some useful benefits.

Other features of the device of FIG. 1 include a finger grip 9 designed to make the device comfortable to use. A template trace edge 3 designed to make it easy to use the device with a template. A color indicator 10 designed to show the color, type and surface finish, and other characteristics, of the decorating material and or blade.

A user uses the device of FIG. 1 like a regular pen type marking device and instead of simply marking they mark and cut simultaneously.

Figure 2:
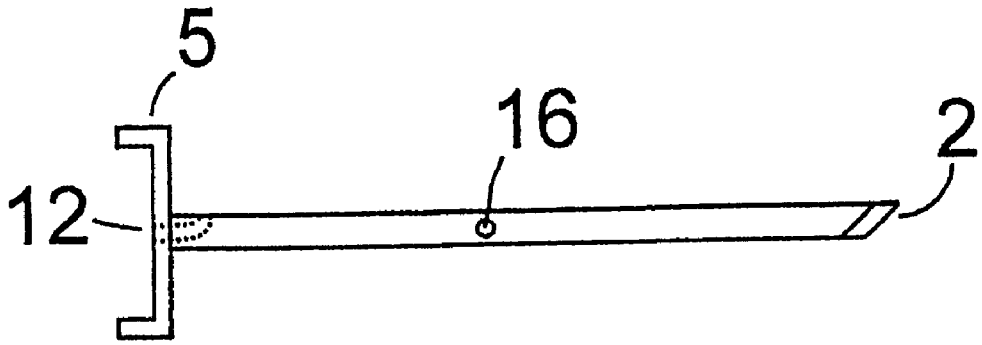
FIG. 2. is a side view of the cutting blade shown in FIG. 1.

FIG. 2 shows a side view of the cutting assembly with cutting edge 2, base 5, hole 16 for attachment pin 11 and decorating material duct 12.

Figure 3:
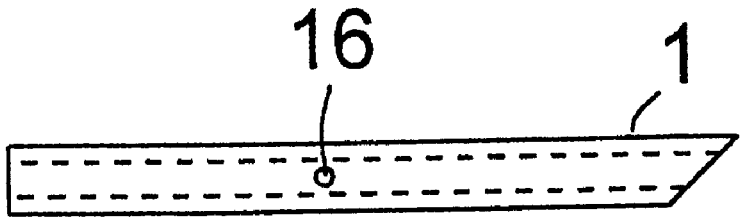
FIG. 3. is a side view of the nib with opening to accept the cutting blade shown in FIG. 1.

FIG. 3 shows the nib 1 with its hole 16 for attachment pin 11 and opening through its center to accommodate the cutting assembly.

Figure 4:
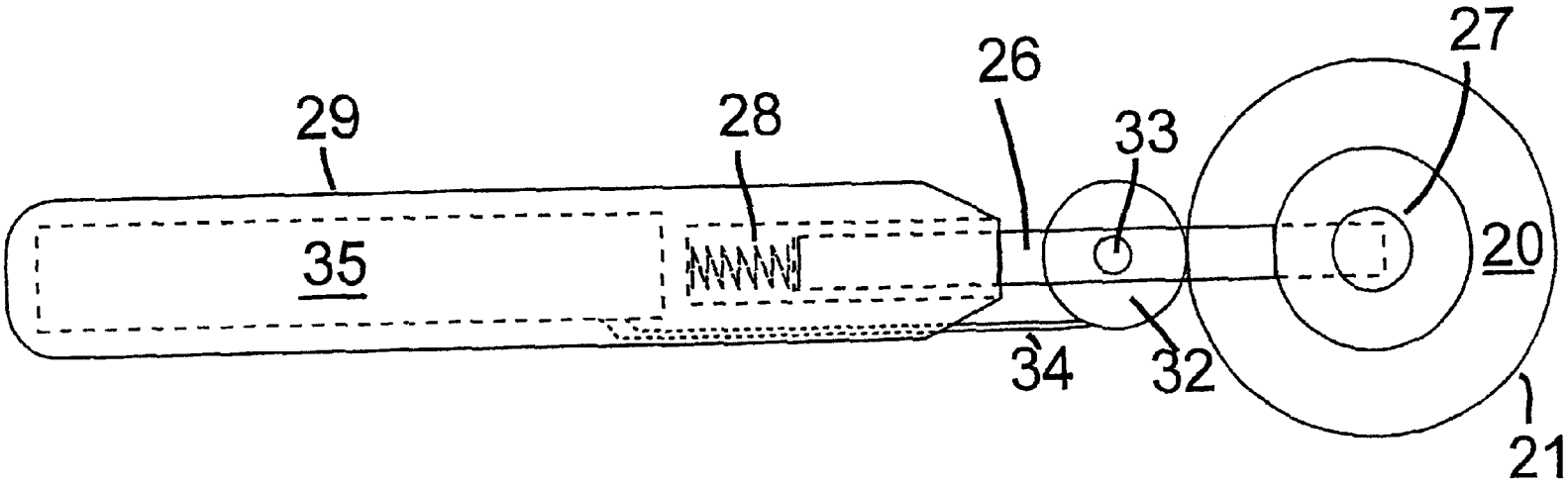
FIG. 4. is a side view of a rotating cutter and decorating device of the present invention.

FIG. 4 shows a side view of an additional embodiment of the invention using a rotating cutter assembly, rotating decorating assembly with decorating material supply pad. The device uses a rotating blade, with flat or shaped cutting edge, in cooperation with a rotating decorating device.

This embodiment stores the decorating material in the decorating material storage vessel 35 and feeds it to the decorating material supply pad 32 via the decorating material supply 34 that can use capillary, wicking or any other suitable transmission action.

A user uses the device by holding the handle 29 and pushing the decorating disk 20 and cutting disk 21 on a target object and then applying force in the direction they wish to cut and decorate.

The spring 28 gives the device a softer feel and more control over the pressure that is applied.

Figure 5:
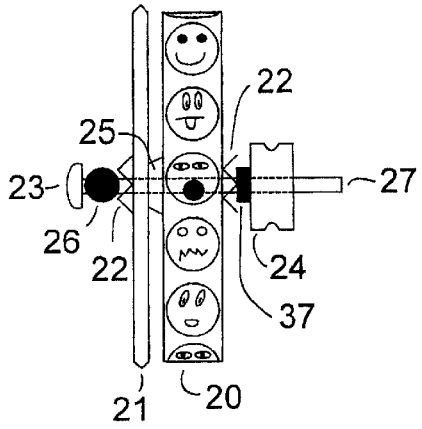
FIG. 5. is a bottom view of device shown in FIG. 4.

FIG. 5 shows a bottom view of the device shown in FIG. 4. Screw head 23 acts as one end of the shaft that holds the decorating disk 20, guide shaft 26, spacing washer 25, wave spring 22 and cutting disk 21 assembly. The other end is closed by a locking nut 24 that is used to close the end of the shaft and also acts as a tensioning adjustment. This embodiment shows a flat round blade that will produce a straight edge cut. It is important to note that a shaped blade edge is used, with or without spacers, to make cuts of varying shapes at varying distances from the decoration. The device is assembled with the guide shaft 26, and other components, arranged differently to create different effects and different feels when being used. As one example, the device is assembled with the shaft on the right side of the cutting and decorating disks to allow easier use by a left handed person. Another example is to assemble a shaped cutting disk on the left side of the guide shaft 26 with a 2 mm sized spacer 37 and the cutting disk on the right side of the guide shaft 26 with a 3 mm sized spacer 37. This would allow creation of a shaped cut edge with the design being made 5 mm plus the size of the guide shaft away. Another configuration includes using a nut, acting as a spacer, with the blade and guide shaft held securely and a decorating disk held loosely on the other side. This configuration would make consistent cuts with inconsistent and random designs that might be very appealing when interested in creating one of a kind, natural patters or security bands that need to be difficult to duplicate.

Figure 6:
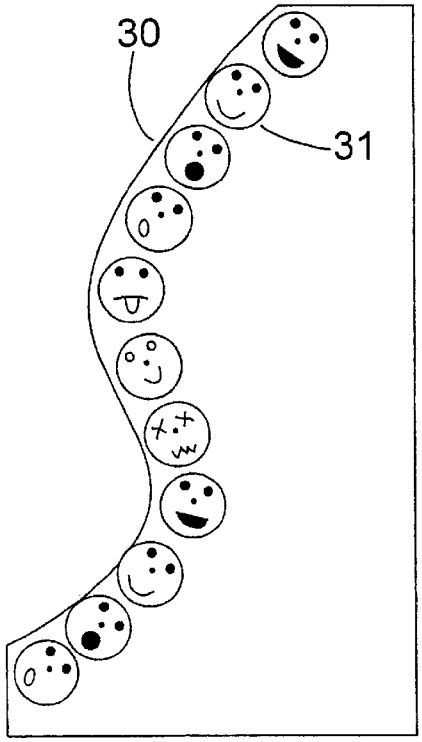
FIG. 6. is a top view of a cut and decorated edge.

FIG. 6 shows a cut edge with a design on the right of it, as one might see, created by a device as shown in FIG. 4.

Figure 7:
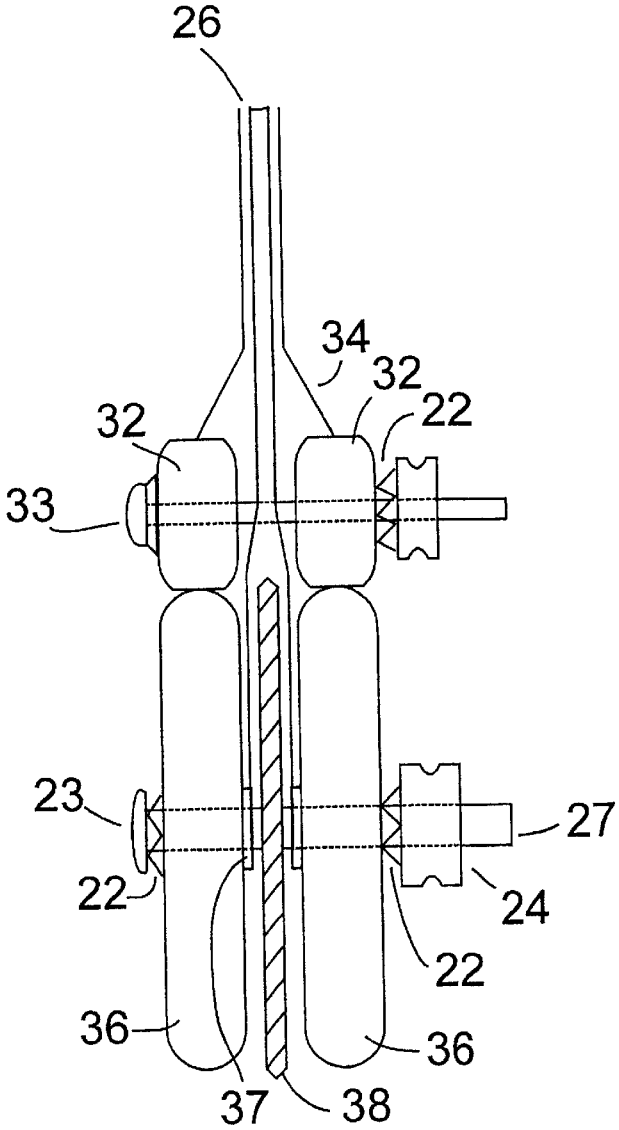
FIG. 7. is a front view of a dual decorating wheel device with a single shaped cutting wheel and sized spacers.

FIG. 7 shows an embodiment of the device that uses multiple decorating wheels 36 and a single cutter 38. In this embodiment two different decorating material supply pads 32 are used, one to supply each decorating wheel 36, but each using different decorating materials. This allows the device to color each side of the cut with different, or same, material. In this configuration the main cutting blade 38 is sandwiched between two legs of a guide shaft 26. The main cutting wheel 38 shown is a perforation wheel, as shown by the diagonal lines, so instead of making a full cut wheel 38 makes a perforation that can be later hand torn to the shape with the decoration on each side. Cutting wheel 38 can be interchanged to create different effects and different types of cuts or other operations like embossing, engraving, punching or any other desirable outcome. The screw head 23 maintains the assemblies on shaft 26. The wave washer 22 allows the nut and tension adjustment 24 to remove slack from the assembly, which allows it to turn as freely or as tightly as the material being cut and decorated and the user needs and wants it to. The support screw 27 is sized to accept at least one cutting wheel 38 and at least one decorating wheel 36. One or more cutting wheels 38 and one or more decorating wheels 36 and one or more sized spacers are assembled in varying configurations that perform various tasks of decorating and cutting. This allows these devices to make cut and decorated edges and also strips cut on both sides with decorations down the center. It can create one to many strips each with cut edges and or perforations and designs all at the same time. The decorating material supply 34 draws decorating material from the decorating material storage vessel 35. If desired the decorating material supply 34 can be discarded and instead the decorating material supply pad 32 can store the decorating material. Replacing the decorating material supply pad 32 will replenish the decorating material supply. This configuration also allows for quick decorating material changes.

Figure 8:
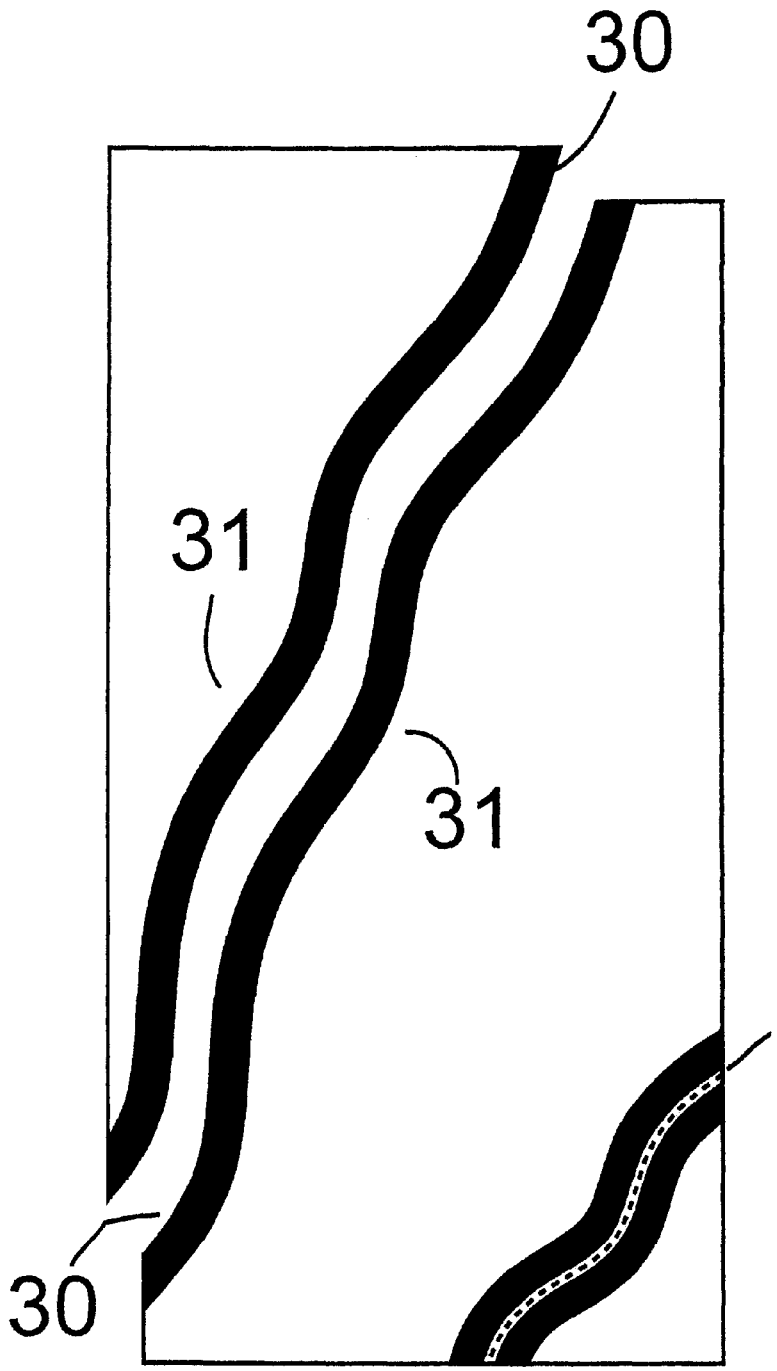
FIG. 8. is a top view of a cut and decorated edge using the dual decorating wheels and a single round flat cutting wheel with the device of FIG. 7 and a perforating wheel with the device of FIG. 7.

FIG. 8 shows a target material, like a sheet of paper or cloth, with edges created by the device of FIG. 7. The single cut is surrounded by two decorated edges. The decoration is almost touching the cut edge because a small spacer 37 is used to separate the blade 38 from the decorating wheel 36. The cut edges shown in FIG. 8 are made with a straight flat cutting wheel like the one shown in FIG. 5. The decorated perforation 39 is created from a device configured with a perforation blade and two decorating wheels.

Figure 9:
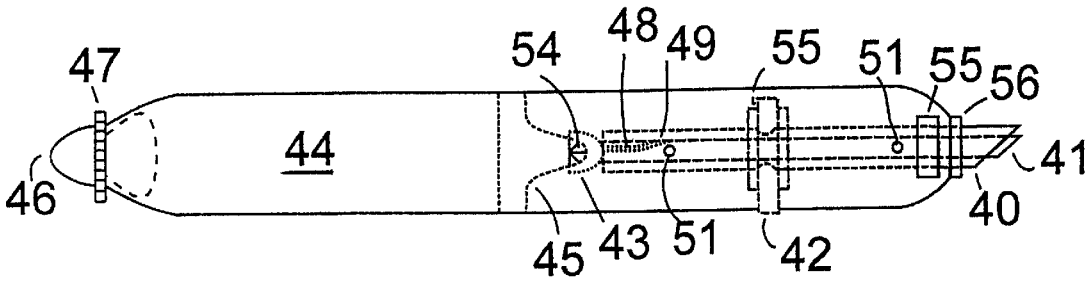
FIG. 9. is a side view of a swivel blade cutting and decorating device of the present invention.

FIG. 9 shows an embodiment of the present invention that uses a swiveling blade nib assembly to allow easy creation of curved cuts and designs. The cutting blade 41 is attached to the decorating nib 40 and the swivel mount 55 to create an assemble that can rotate about the cutting edge of the blade. The blade nib end support 43 interfaces with the decorating material valve 54 that is attached to the blade nib support spring 45. When pressure is applied to the blade 41 and nib 40 the decorating material valve 54 opens to provide decorating maternal to the nib 40. Decorating material valves are generally known to those skilled in the art. Valve 54 includes a rounded and cut through piece of material that will keep the decorating material in the decorating material storage area 44 until pressure is applied then it will leak, at the seams of the cuts thus supplying decorating material. The decorating material that is released is drawn by the decorating material feed 48 and then through the decorating material exit opening 49 to the nib. Wicking or capillary action can draw the decorating material to the tip of the nib and the nib will draw the material to its end. The rounded top of the decorating material valve acts as a bearing for the blade nib end support 43 and helps lower friction to increase ease of swivel action. The blade and nib assembly is held in place by the blade nib retaining lock 42. The blade nib retaining lock 42 is moveable far enough away from the blade nib assemble to allow it to be removed and replaced with a new or different blade nib assemble. This will allow a user to change the blade and nib either to replace a well-worn blade and/or nib or to use one with different characteristics like thickness or shape of nib or size or type of cutter.

Figure 10:
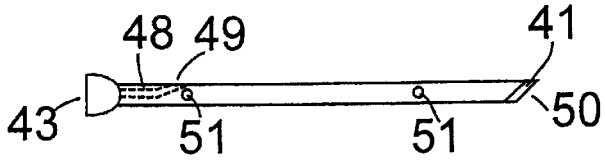
FIG. 10. is a side view of a cutting blade with decorating material duct of FIG. 9.

FIG. 10 shows the blade with its end support 43, decorating material feed 48, decorating material exit opening 49, blade nib attachment means 51 and cutting edge 50. The use of each of these is outlined in the embodiment above.

Figure 11A:
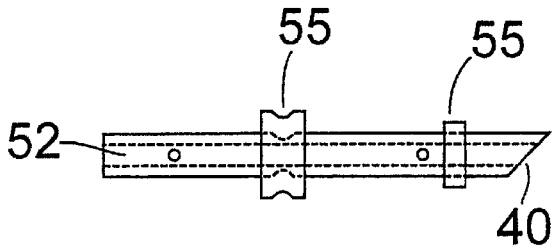
FIGS. 11*a*. and 11*b*. are side and front views of a decorating nib of FIG. 9.
Figure 11B:
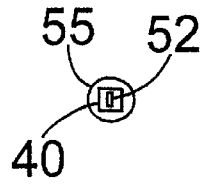

FIGS. 11*a*. and 11*b*. show the nib 40 with swivel mounts 55 and duct 52 for blade. Swivel mount 55 is used to attach the nib and blade in a manner that will allow them to be firmly pressed to the target material yet still swivel to cut and decorate curves.

Figure 12A:
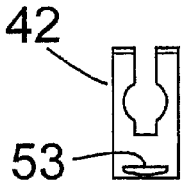
FIGS. 12*a*. and 12*b*. are top and side views of the blade nib lock of FIG. 9.
Figure 12B:
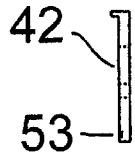

FIGS. 12*a*. and 12*b*. show the blade nib retaining lock 42 details. It has a fingernail pull recess 53, and entry slot and a cylindrical cutout in the center that supports and snaps onto the center swivel mount attached to the blade nib assembly.

Figure 13A:
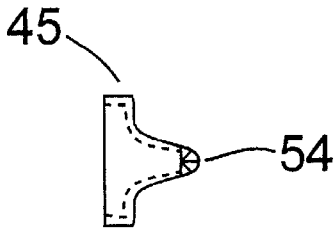
FIGS. 13*a* and 13*b*. are side and bottom views of the blade nib support and decorating material valve of FIG. 9.
Figure 13B:
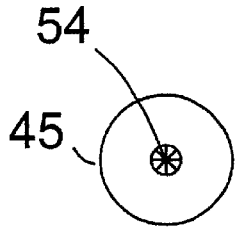

FIGS. 13*a*. and 13*b*. show the blade nib support spring 45. This is made of a springy material that also acts as a barrier holding in the decorating material in the decorating material storage area 44. When the blade nib support spring 45 is pressed, by the force of using the blade and nib, the slits in the decorating material valve open enough to allow decorating material to pass from storage to the decorating material feed 48.

Figure 14D:
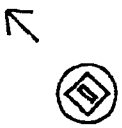
FIGS. 14*a*., 14*b*., 14*c*. and 14*d*. are top views showing the blade and decorating nib of FIG. 9 in various positions.
Figure 14C:
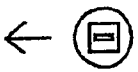
Figure 14B:
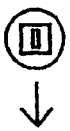
Figure 14A:
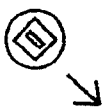

FIGS. 14*a*.–14*d*. show how the blade and nib will swivel in the direction of the desired cutting and decorating as the user uses the device.

Figure 15:
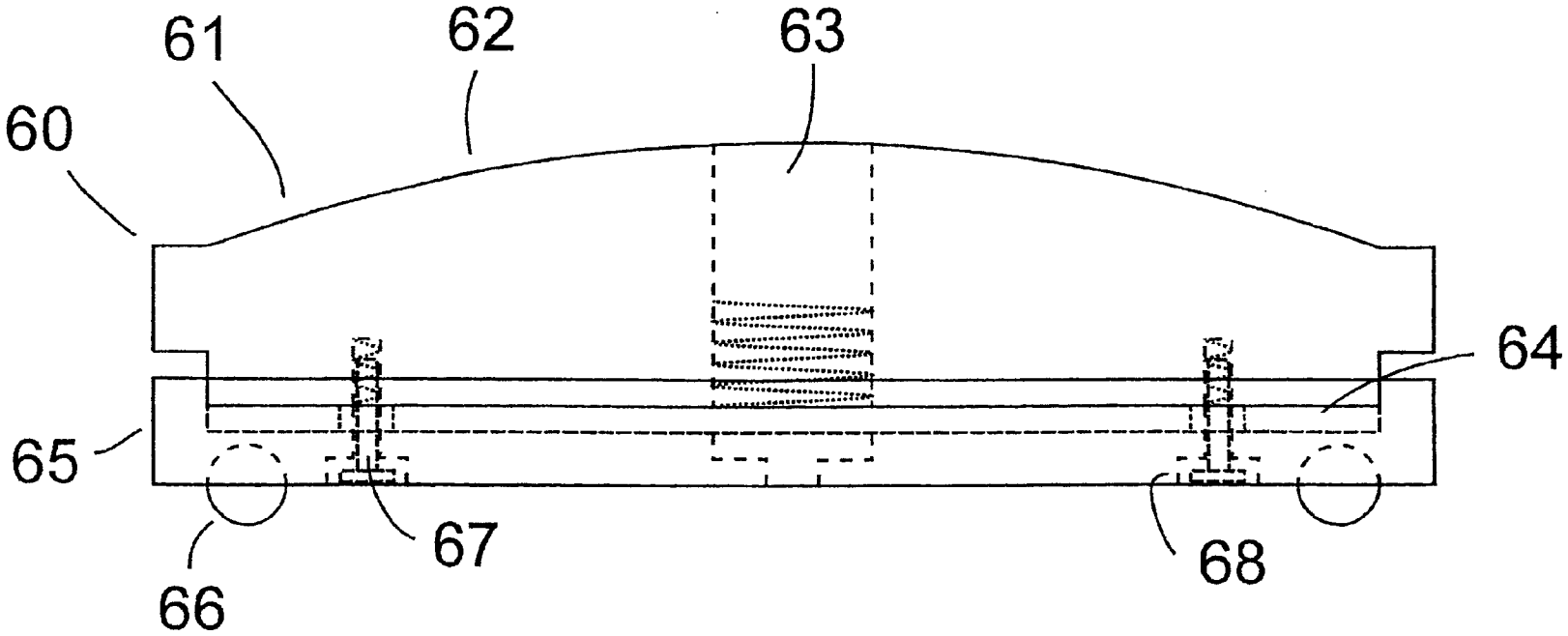
FIG. 15. is a side view of an additional embodiment of the present invention.
Figure 20:
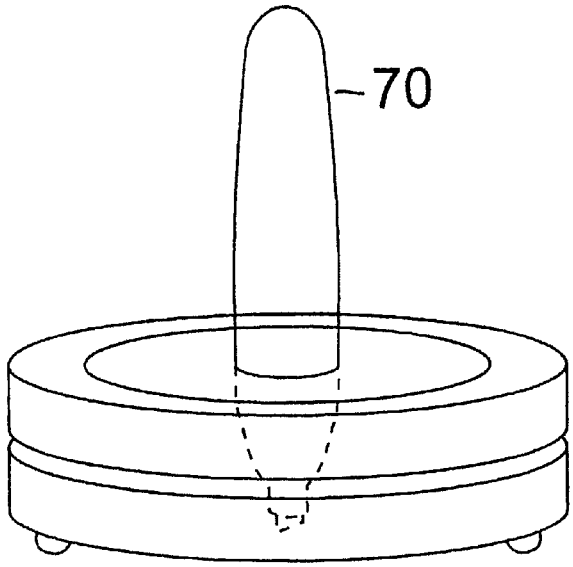
FIG. 20. is a perspective view showing the attachment of FIG. 15. and a cutting decorating device.

FIG. 15 shows an attachment that allows a swivel cutting and decorating device, like the one described above in FIG. 9, to be more easily controlled. A swivel cutting and/or decorating device is attached to the device as shown in FIG. 20. The user inserts the pen, cutting implement, or a cutting and decorating device into the pen and cutter opening 63 and screws it into the threaded pen attachment location 69. This attachment can also be made by friction, a pin or other forms of attachment. Now the user can hold the edges of the device, with one to many, fingers on the finger grip 61. The user can see the target material and the cutting and decorating tool through the magnifying lens 62. By pushing down on the finger grip 61 the silicon like see through spring 64, or a real spring, compresses allowing the blade and/or nib to contact the target material. Moving the device with the top element pressed down will cause the decoration and/or cutting to take place at the point the decorating and/or cutting assembly contacts the target material as seen through the lens. Rollers 66 assist the device moving across the target material and also keep the blade and nib from contacting the target material until engaged to do so.

Figure 16:
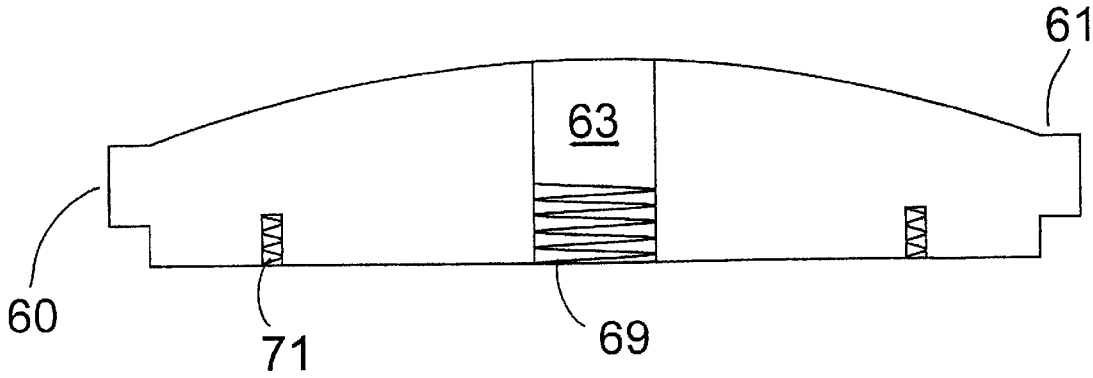
FIG. 16. is a side view of the top component of the device shown in FIG. 15.

FIG. 16 shows the top assembly 60 of the device. Its center opening 63 firmly holds the decorating and cutting device, which can have screw threads that mesh with those inside the center opening 63. The assembly threaded opening 71 allows the top assembly 60 to be attached to the bottom assembly 65 via a screw passed from the bottom assembly 65 through the spring 64 and finally screwing into the top assembly 60.

Figure 17:
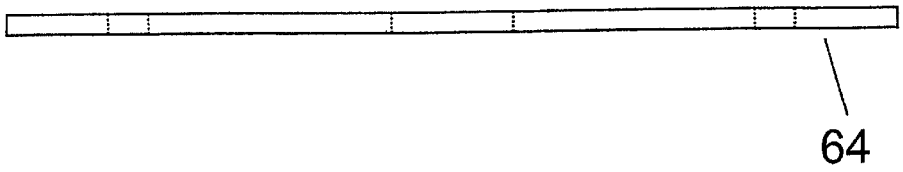
FIG. 17. is a side view of a piece of see through compressible material of FIG. 15.

FIG. 17 shows one embodiment of a spring 64 that uses a piece of compressible clear material, such as, for example, gel or silicon, with openings molded or cut into it to allow it to match the openings in the top and bottom assemblies. The spring 64 acts as a spring and also allows the target material to be more viewable.

Figure 18:
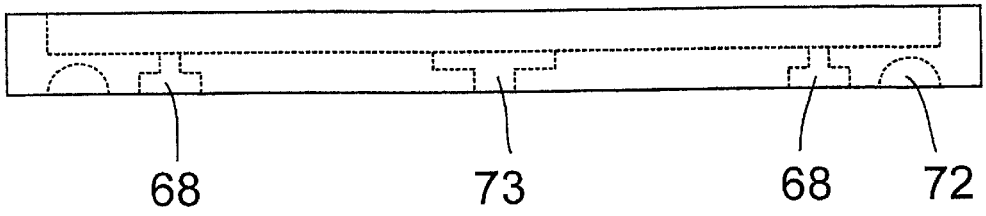
FIG. 18. is a side view of the bottom component of the device shown in FIG. 15.

FIG. 18 is the bottom assembly 65. The pass through 73 allows the pen to freely move up and down as the pressure on the top assembly 60 dictates it should. It also has a stop on it to keep the pen and or cutting device from slipping out the bottom of the entire device. Roller snap-in recesses 72 are designed to allow a ball bearing type roller to be snapped in place and then to freely turn to assist in rolling the device across a target material. Assembly screw recesses 68 allow a screw to connect the top and bottom assemblies, along with their integrated components, together.

Figure 19:
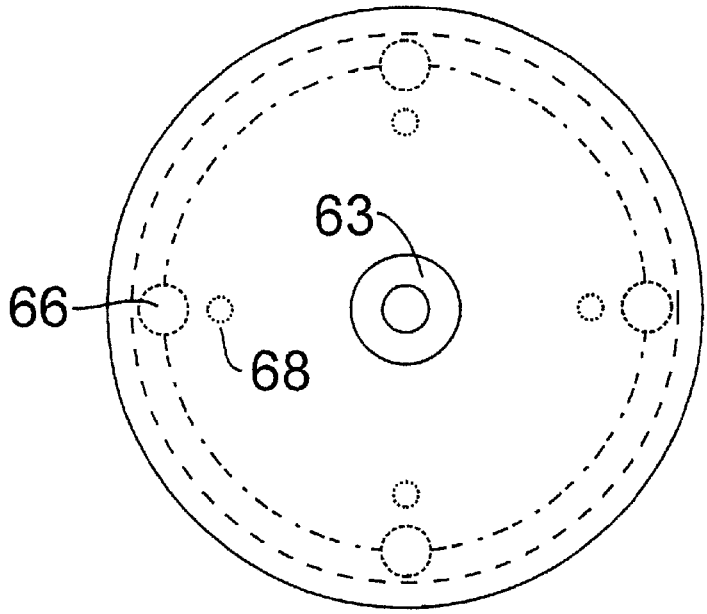
FIG. 19 is a top view of the device shown in FIG. 15.

FIG. 19 is a top view showing a device and one possible layout of rollers 66 and assembly screw recesses 68.

FIG. 20 is an orthogonal view of one embodiment of the device showing the pen and or cutting device in the center.

The shape of the entire device can be any shape. A circle was selected as an example and should not be considered limiting. Hand conforming tear drop shapes, square, rectangle, oval, shapes of company logos and any other shape that would be desirable could be used.

Figure 21:
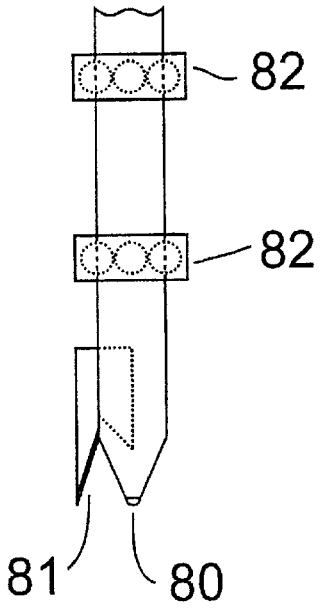
FIG. 21. is a side view of a pull blade and ball bearing system with ball bearings as support and to facilitate rotation and swiveling and or for applying decorating material in accordance with the present invention.

FIGS. 21. and 24. show a modified blade roller assembly that uses the roller to distribute decorating material while cutting or uses the roller simply to assist in cutting or uses the roller to distribute a material or solution that performs a task or assists in cutting without decorating or applying any material. This embodiment of the invention uses a pull cutting blade 81 with a roller 80 set ahead of it. The roller 80 scores a path in front of the blade 81 assisting the blade in cutting along a specific path. The roller 80 also allows a user to make more accurate and intricate turns and curves. In addition to other benefits the roller 80 provides a cushion protecting the cutting blade and or limits the cutter's depth protecting beneath the material by pushing the cutter above the material. Ball bearings 82 are used to support the device in a manner that allows it to swivel freely.

Figure 22:
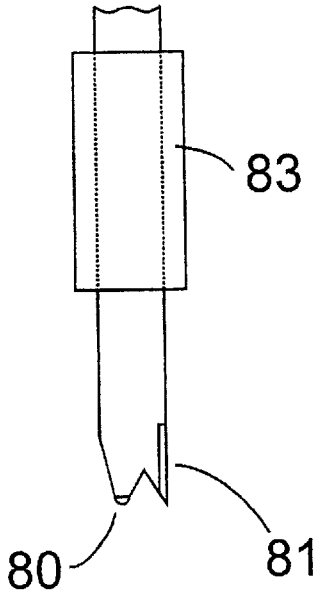
FIG. 22. is a side view of a push blade and ball bearing system with low friction sleeve as support and to facilitate rotation and swiveling and or for applying decorating material in accordance with the present invention.

FIGS. 22. and 25. show a modified blade roller assembly that uses the roller to distribute decorating material while cutting or uses the roller simply to assist in cutting or uses the roller to distribute a material or solution that performs a task or assists in cutting without decorating or applying any material. This embodiment of the invention uses a push cutting blade 81 with a roller 80 set behind it. The roller 80 assists the blade 81 in rolling across the target material. The roller 80 also allows a user to make more accurate and intricate turns and curves. In addition to other benefits the roller 80 also provides a cushion protecting the cutting blade and limits the cutter's depth protecting beneath the material by maintaining the cutter above the material. A low resistance sleeve 83 is used to hold the shaft in place in a manner that allows it to swivel freely.

Figure 23:
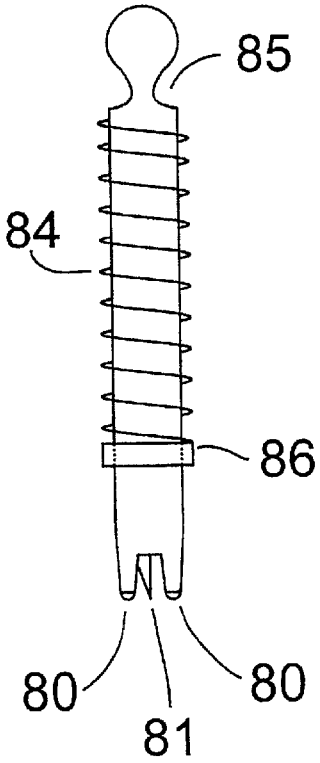
FIG. 23. is a side view of a push blade with multiple ball bearings surrounding it to facilitate rotating, swiveling and cutting in accordance with the present invention.
Figure 24:
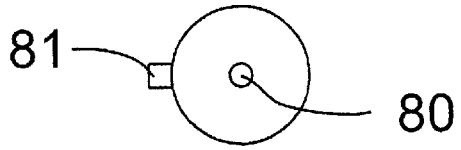
FIG. 24. is a bottom view of the pull blade of FIG. 21.
Figure 25:
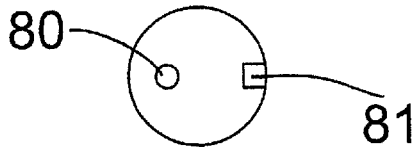
FIG. 25. is a bottom view of the push blade of FIG. 22.
Figure 26:
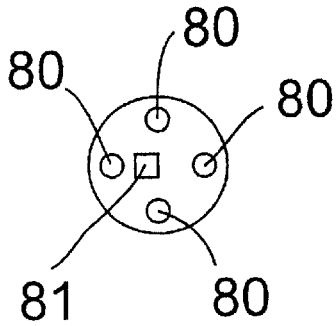
FIG. 26. is a bottom view of the multiple ball bearings surrounded blade of FIG. 23.

FIGS. 23. and 26. show a modified blade roller assembly that uses the roller to distribute decorating material while cutting or use the roller simply to assist in cutting or use the roller to distribute a material or solution that performs a task or assists in cutting without decorating or applying any material. This embodiment of the invention uses a centrally located cutting blade 81 with, more than one, roller 80 set near it. The rollers 80 assist the blade 81 in rolling across the target material. The rollers 80 also allow a user to make more accurate and intricate turns, cuts and curves. In addition to other benefits the rollers 80 also provide a cushion protecting the cutting blade and limiting the cutter's depth protecting beneath the material by maintaining the cutter above the material. A low resistance sleeve 84 shaped and acting like a spring is used to hold the shaft in place in a manner that allows it to swivel freely. The ball end and concave low resistance mount means 85 allows the device to be attached to a receptacle that will hold it firmly in place and allow it to swivel.

In the embodiments shown in FIGS. 21, 22, 23, 24, 25 and 26 it is important to note that the blade can be made to be higher or lower than the rollers and/or at different angles in relation to each other to provide different advantages when cutting different materials. Separate adjustments are added to allow manual adjustment to be made allowing the user to adjust the orientation and/or height of the roller, or rollers, in reference to the blade or blades. These devices may be made, for example, with one or more blades and one or more rollers in any orientation or configuration that is found to be advantageous and/or as the needs of the task require or would be assisted by.

Figure 27:
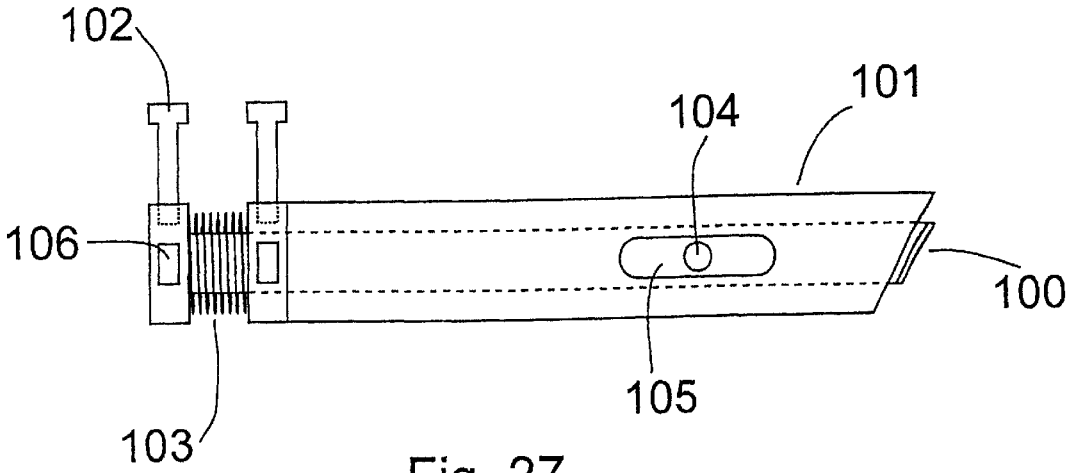
FIG. 27. is a side view of a retractable blade nib assembly in the cut and decorate position in accordance with the present invention.
Figure 28:
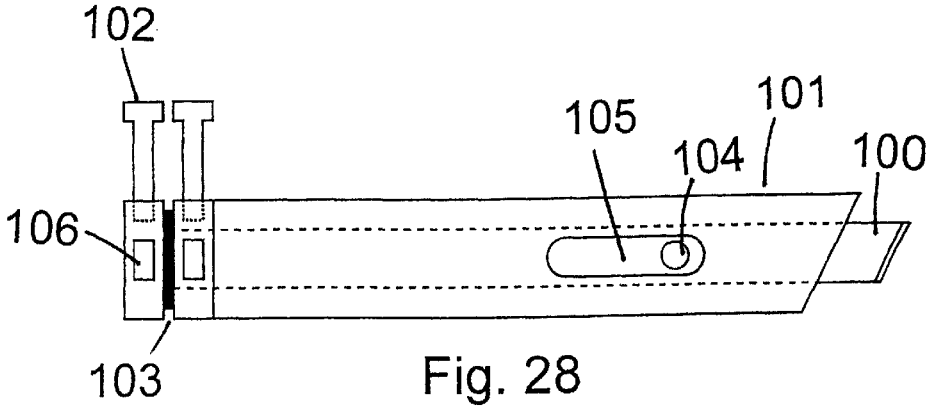
FIG. 28. is a side view of the blade nib assembly of FIG. 27. in the cut only position.
Figure 29:
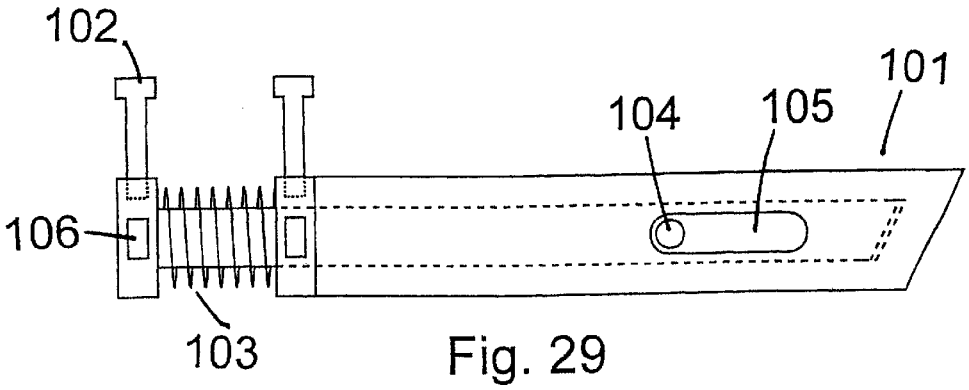
FIG. 29. is a side view of the blade nib assembly of FIG. 27. in the color only position.

FIGS. 27, 28 and 29 show a blade and nib configuration that allows the user to set the tool so it will exhibit different characteristics. By moving the blade and or nib a user can change the way the tool works and acts. For example if the user moves the nib all the way out, toward the target material, and then moves the blade toward the inside of the device, further away from the target material, the user could set the blade so it only scores, instead of cuts through, the target material while it is decorating the target material. If the user moves the blade all the way into the device the device will still decorate the target material but will not score, mark or cut it. By moving the nib slightly into the device and the blade all the way out the user could cut the target material and only lightly mark it or move it further in and not mark it at all. Different combinations of relationships between the blade and nib and their performance on different target material can produce different useful results. This makes this tool quite useful and able to adapt to different target material and to perform many useful functions.

The following descriptions show some of the many ways the relationship between the protrusion of the blade and nib from or into the device and the relationship between the blade and nib can be used to create some of the many combinations of features this device can perform. These drawings are not meant to be limiting but simply meant to show examples of several of the almost infinite possible combinations of the blade, nib and device relationship.

FIG. 27 shows the blade 100 and nib 101 in a position that allows the user to cut and decorate simultaneously. The handles 102 allow the user to engage or disengage the blade and/or nib. A spring 103 helps to tension the blade and nib and the incremental movement position fins 106 work with ridges inside the case to cause the blade and nib to click as they are moved and also biases them to stay in the position they are set in. By placing more ridges inside the case the user has more ability to determine the incremental distance in the relationship between the blade and the nib and the blade and nib's protrusion or insertion into the device. The fin 106 works similar to a locking blade in a cable tie and the ridges are similar to the ridges in the cable tie's main strip. In a cable tie the locking blade and ridges allow for movement in only one direction but in this device the movement is allowed in both directions.

FIG. 28 shows the blade 100 and nib 101 in a position that allows the user to cut without decorating. The handles 102 allow the user to engage or disengage the blade and/or nib. Its other features are similar to the description of FIG. 27 above.

FIG. 29 shows the blade 100 and nib 101 in a position that allows the user to decorate without cutting. The handles 102 allow the user to engage or disengage the blade and/or nib. Its other features are similar to the description of FIG. 27 above.

The user, because of the almost infinite free movement between the blade 100 and nib 101, can select any position for the blade 100 and nib 101. This allows the user to take advantage of the different possibilities created by changing the orientation of the blade to the nib, the blade to the device, the nib to the blade, the nib to the device and the combination of the blade and nib's orientation to the device. Moving the blade and nib all the way into the device closes the device for storage, transportation, and protects the blade and nib and items they come in contact with.

Figure 30:
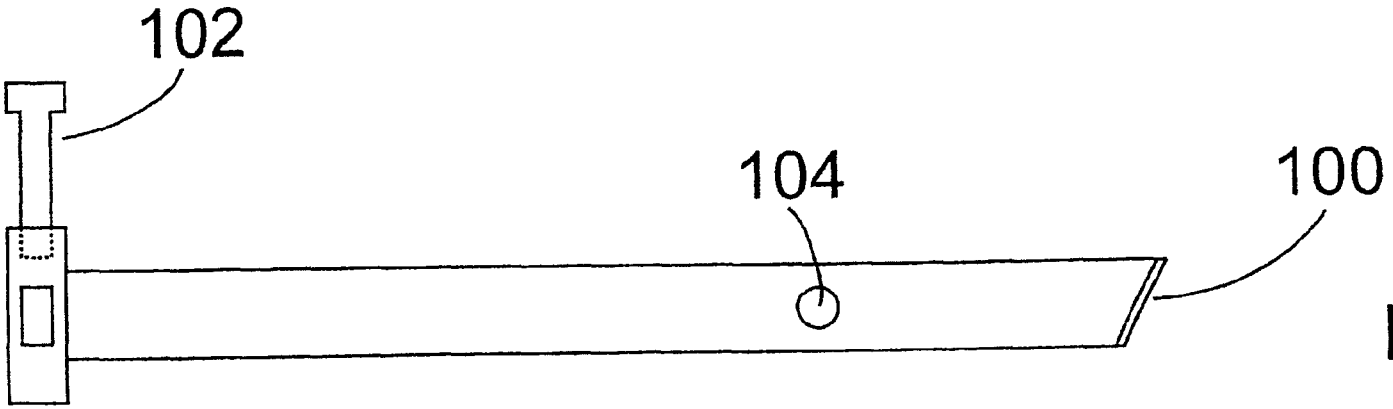
FIG. 30. is a side view of a blade assembly of FIG. 27.

FIG. 30 shows a side view of the blade 100 assembly.

Figure 31:
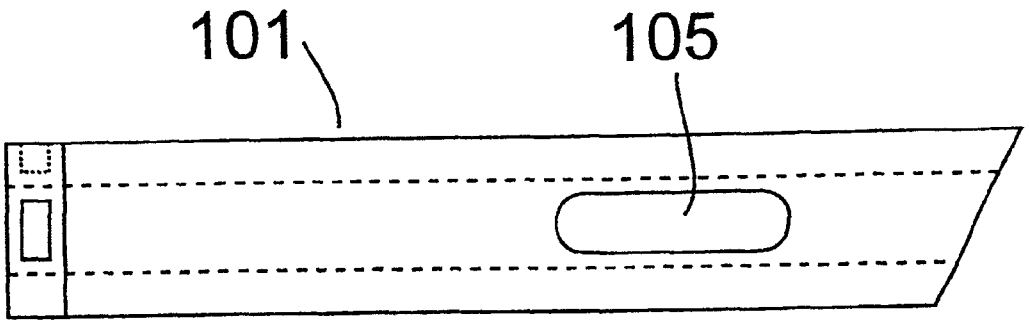
FIG. 31. is a side view of a decorating nib of FIG. 27.

FIG. 31 shows a side view of the nib 101 assembly.

Figure 32:
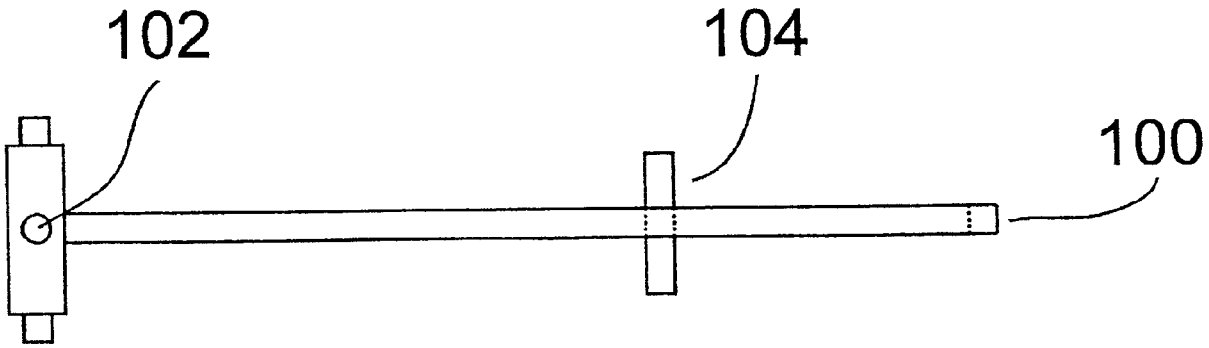
FIG. 32. is a top view of a blade assembly of FIG. 27.

FIG. 32 shows a top view of the blade 100 assembly with a protruding alignment pin to hold the blade and nib in alignment.

Figure 33:
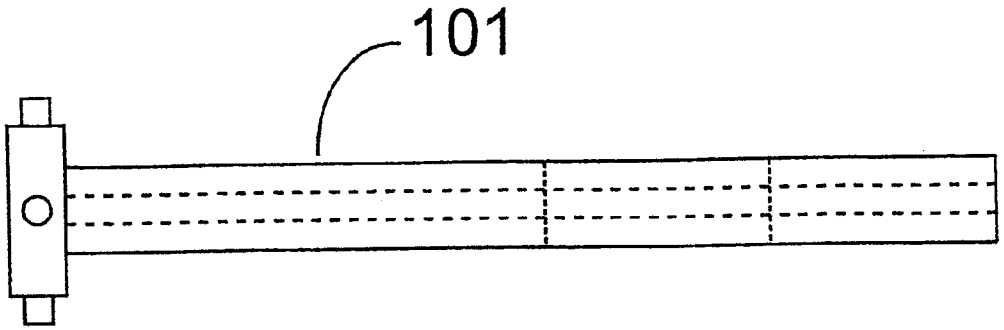
FIG. 33. is a top view of a decorating nib of FIG. 27.

FIG. 33 shows the top view of the nib 101 assembly.

Figure 34A:
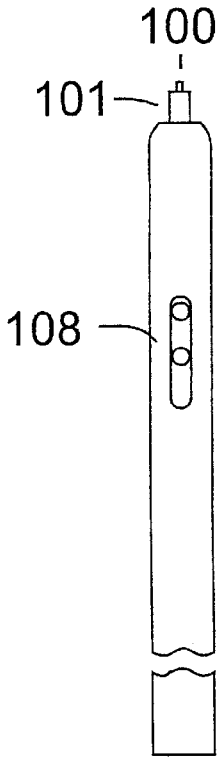
FIG. 34*a*. is a top view of the assembly of FIG. 27. showing the blade and nib handles in a cut and decorate position.
Figure 34B:
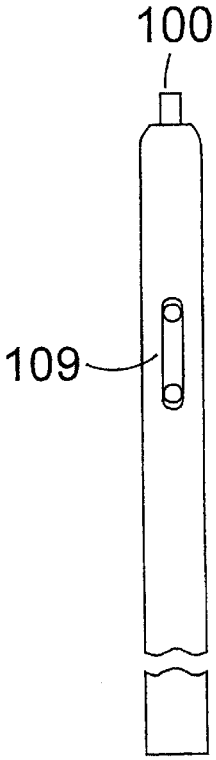
FIG. 34*b*. is a top view of the assembly of FIG. 27. showing the blade and nib handles in a decorate only position.
Figure 34C:
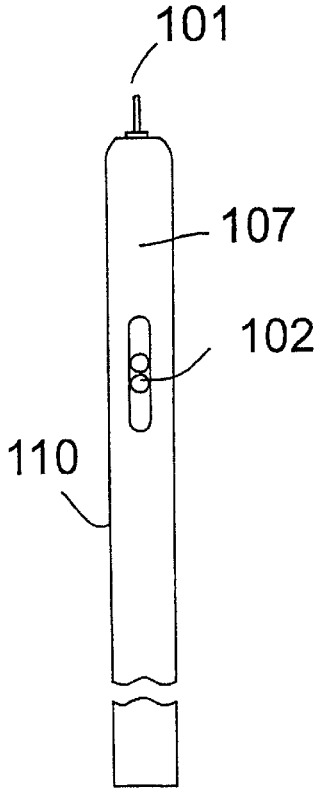
FIG. 34*c*. is a top view of the assembly of FIG. 27. showing the blade and nib handles in a cut only position.

FIGS. 34*a*., 34*b*. and 34*c*. show three top views of the device with its blade and nib in three of their many possible combinations. FIG. 34*a*. shows how the handles 102 would look, in this embodiment, when they are set for cut and decorate. FIG. 34*b*. shows how the handles would look, in this embodiment, when they are set for decorate only. FIG. 34*c*. shows how the handles would look, in this embodiment, when they are set for cut only.

The blade and nib can be moved in any combination and to orient themselves to each other and the device itself in any manner. Indicator indicia and or pronounced internal ridges and or internal or external stops can be added to the device to allow easy reference for setting the tool. If, for example, we find an optimal setting for a target material, like ⅛ inch thick leather, to be with the blade as far out as possible and the nib to be 1/16 inch further away, toward the device, causing the blade to protrude 1/16 inch beyond the nib. It could be noted on the device, in a visual, auditory, tactile or combination of any or all three methods of indication of this optimal position for the blade and the nib. This allows the user to set the device quickly for the task or material at hand.

Figure 35:
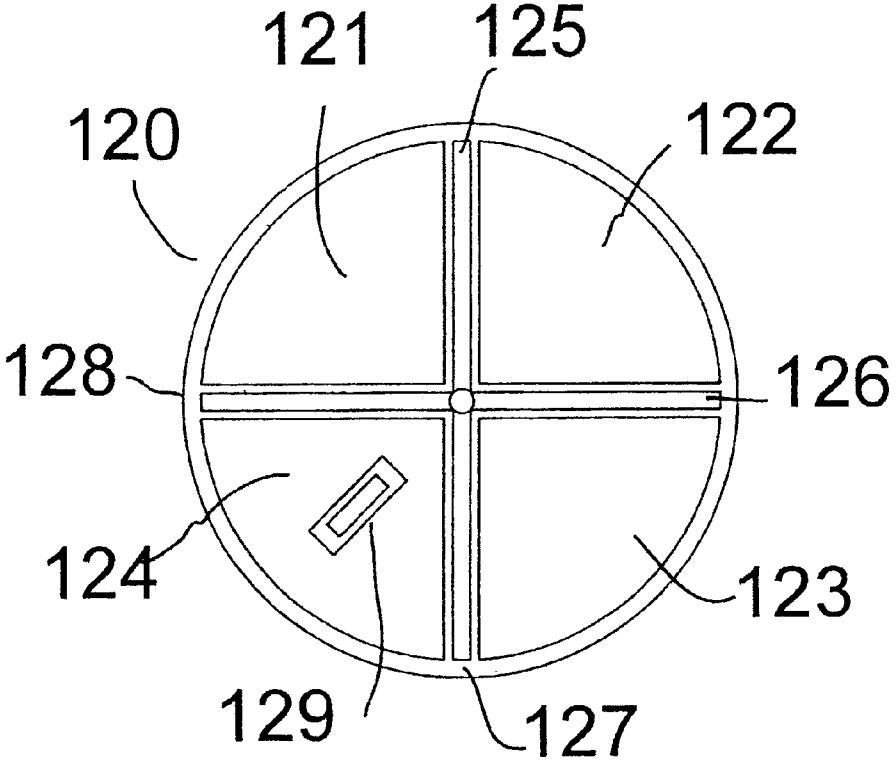
FIG. 35. is a bottom view of a further embodiment of the invention with four decorating surfaces and five cutting surfaces.

FIG. 35 shows a bottom view of an embodiment of a multi-edged decorating and cutting device with three non-cutting colored nibs 121, 122, 123, one colored nib 124 with internal cutter 129, a four faced blade assembly 133 with four cutting edges 125, 126, 127, 128 and a case 120 holding everything. A user can use one cutter with two nibs simultaneously. For example if one orients the first cutting edge 125 directly toward the target material they will also be orienting the first color nib 121 and the second color nib 122 so that when the device is being used the end result will be a cutter with the decorating material from nib 121 on the one side of the cut and decorating material from nib 122 on the other side of the cut with the cut, made by cutting edge 125 toward the center. The user could also orient one of the non-internal cutting nibs 121, 122, 123 toward the target material. This will allow them to apply decorating material without cutting. When the nib 124 with the internal cutter 129 is used it will apply decorating material from itself around the internal cutting blade 129. The nib is used with cutting blades 127 and 128 and associated nibs 123 and 121 respectively to produce results similar to the other nib and without using the internal cutter. This nib is also used with its internal cutter 129 by itself.

Figure 36:
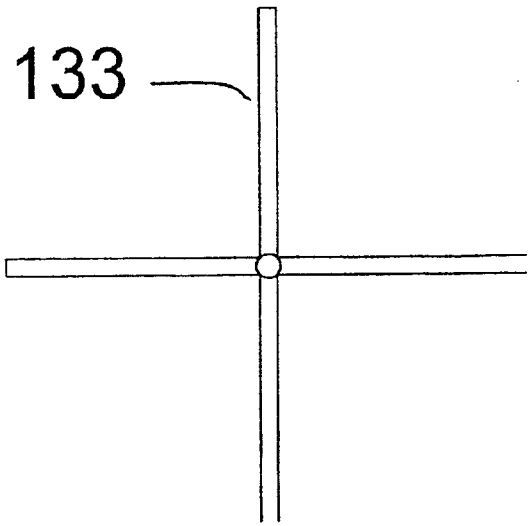
FIG. 36. is a bottom view of the four cutting surfaces of the device of FIG. 35.

FIG. 36 shows a bottom view of the four faced blade assembly 133.

Figure 37:
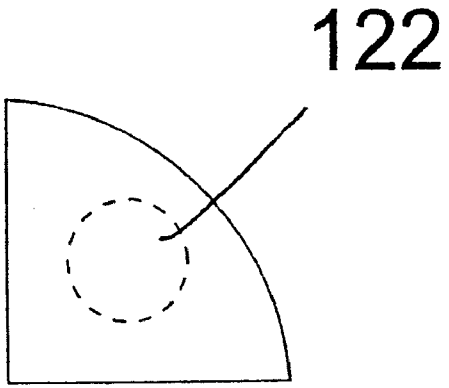
FIG. 37. is a bottom view of a decorating nib of FIG. 35.

FIG. 37 shows a bottom view of the second color nib 122.

Figure 38:
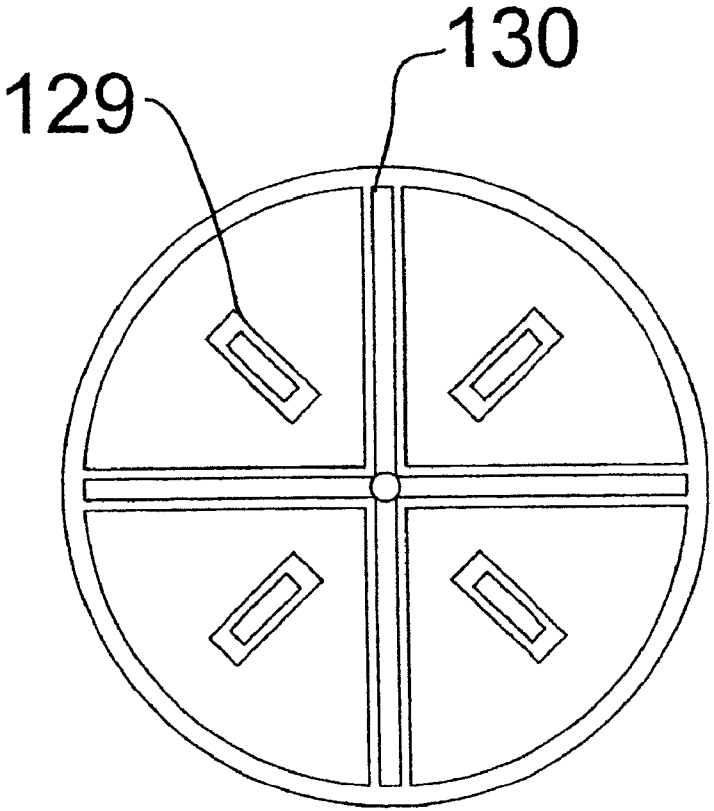
FIG. 38. is a bottom view of a further embodiment of the invention with four decorating nibs and each containing one internal cutter.

FIG. 38 shows a bottom view of an embodiment with four nibs that contain internal cutters 129. A spacer 130 is used to separate each nib, and thus each cutter, a specific distance. This keeps the nib far enough away to avoid contamination from one nib to another. This device can be used to create cuts on which both of its edges have applied the same decorating material or material to perform a specific task. The internal cutter will cut while the nib applies the decorating material around the cut. This device contains four different decorating materials or other types of materials. And the user selects which cutter and material they are applying by rotating the case, in reference to whatever is holding it be it their hand or some other holding device, to orient the correct nib and cutter for the task toward the target material.

Figure 39:
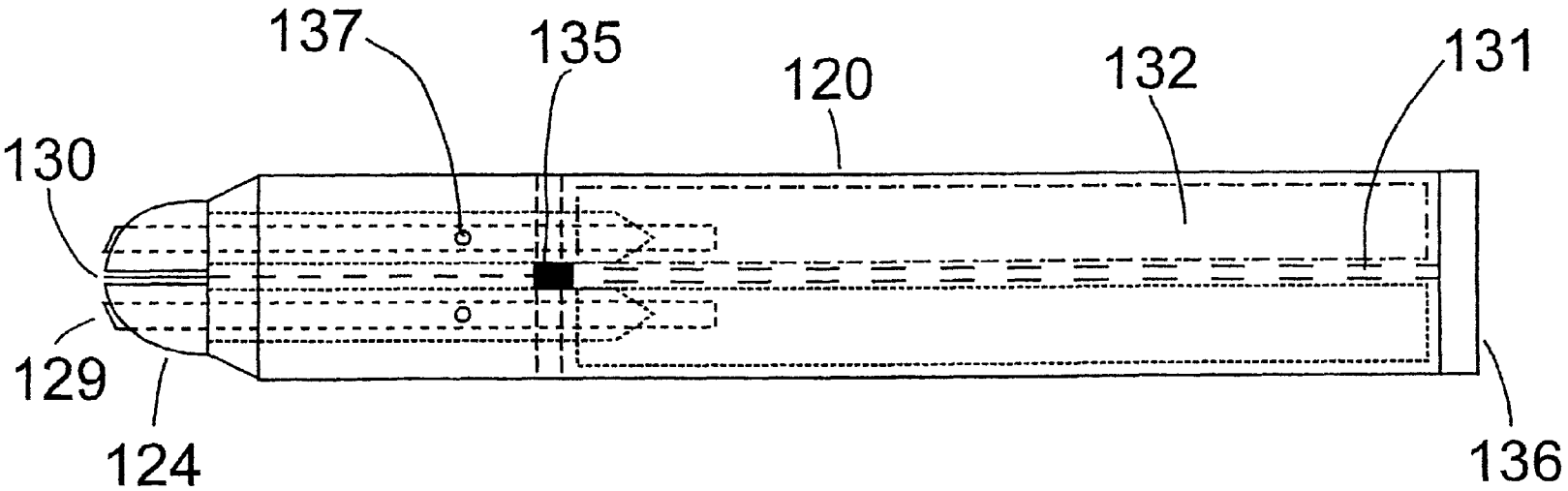
FIG. 39. is a side view of device of FIG. 38.

FIG. 39 shows a side view of the device shown in FIG. 38. This view shows how the internal blades 129 are attached to the nibs 124 via a blade to nib attachment means 137. Also this device uses a sized spacer/separator 130 in place of a four faced blade assembly 133, storage vessels 132 and an end cap 136. This embodiment uses the spacer/separator 130 or a four faced blade assembly 133. The springy connector supporting blade and spacer/separator 135 attaches the nibs 124 and internal cutters 129 assembly to the device in a manner that allows the blades and nibs to transfer pressure, applied during use, to compress the springy connector supporting blade and spacer/separator 135 to make the device feel responsive during use and to protect the blades and nibs. The decorating material storage separator 131 keeps the materials that feed each individual nib separate to avoid contamination from one decorating material storage vessel 132 to the other.

Figure 40A:
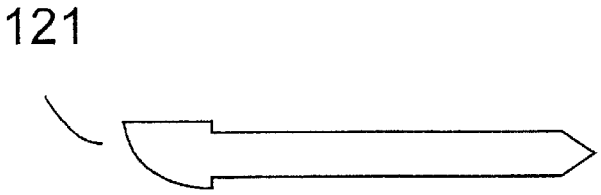
FIGS. 40*a*. and 40*b*. are side and bottom views, respectively, of a drawing nib shown in FIG. 35.
Figure 40B:
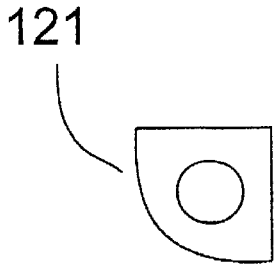

FIGS. 40*a*. and 40*b*. show a side and bottom view of a nib without an internal cutter.

Figure 41A:
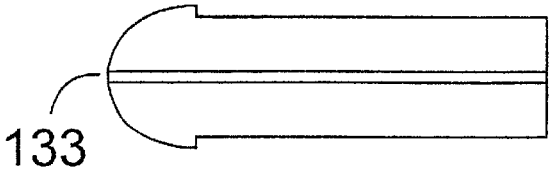
FIGS. 41 *a*. and 41 *b*. are side and top views, respectively, of a four-faced blade assembly shown in FIG. 35.
Figure 41B:
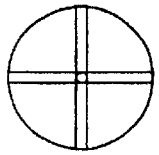

FIGS. 41*a*. and 41*b*. show a side and top view of a four faced blade assembly. A sized spacer/separator would look similar to this with its fins protruding less than the ones shown for the blades because the fins would not need to contact the target material.

Figure 42A:
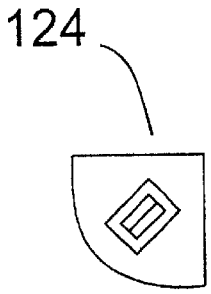
FIGS. 42*a*. and 42*b*. are bottom and side views, respectively, of a decorating nib with internal cutter shown in FIG. 35.
Figure 42B:
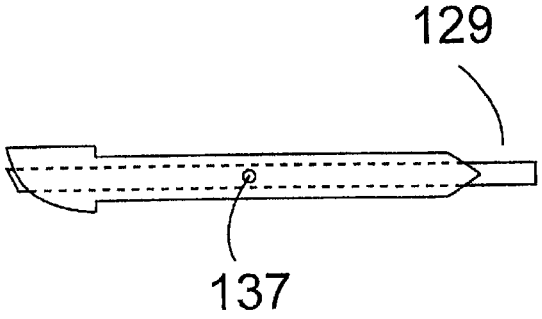

FIGS. 42*a*. and 42*b*. show a bottom and side view of a nib 124 with internal cutter 129 held together by a blade to nib attachment means 137 and the friction made by the assembly itself.

Figure 43:
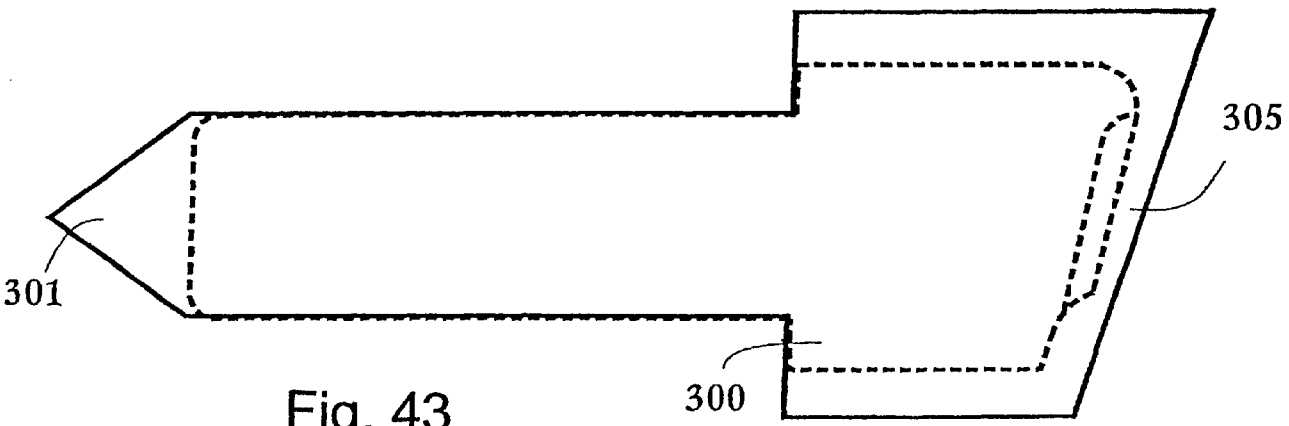
FIG. 43 is a side view of a nib and cutting tool with a safety zone.

FIG. 43 shows a cutting tool 300, a nib 301 and a safety zone 305. The safety zone 305 gives the device the ability to require an advantageous minimum pressure to be placed on the nib 301 before the nib 301 will allow the cutting tool to engage a target material. The cutting tool is set such that it has cutting depth stops and pushdowns that limit the cutting possible and set a working maximum cutting depth. By varying characteristics of the nib 301 including, for example, its composition, material, structure, design, density, rigidity and shape along with the distance, and design, of the cutting tool one can control how and when the nib 301 will allow the cutting tool to contact a target material. The safety zone 305 requires a set minimum pressure to be applied before the cutting tool is able to engage a target material. The safety zone 305 controls how and by whom the device can be used. For example if a device is made with a safety zone 305 that needs a great deal of pressure to allow the cutting tool to engage the device will be safer to use and will require more pressure to engage the cutting tool. This makes it difficult for children to accidentally engage the cutting tool. By making a safety zone 305 that requires little pressure to engage the cutting tool the device will more easily allow the cutting tool to engage the target material. This will allow professionals to use the cutting tool with less fatigue. Various embodiments and configurations will take advantage of the possible safety zone 305 sizes and designs.

The safety zone 305 shown in this embodiment is made such that the nib 301 is denser and more rigid than the average person's skin and body. Nib 301 is designed to be more rigid and denser than the human body because when combined with a cutting tool, set sufficiently back to eliminate its ability to touch the target until the nib 301 compression pressure is reached, a device is created that cannot cut the human body. When the device is applied to the human body, so as to attempt to cut the body or by accident, the pressure applied to the device causes the human body to compress and does not allow the cutting tool to engage. Because the human body is less dense and rigid the pressure applied to the nib 301 causes the body to compress and the nib 301 to maintain its shape. The same nib 301 when applied to a target material on a table or desk will absorb the pressure and allow the cutting tool to engage because the nib 301 is less dense and less rigid than the table or desk. In this embodiment the nib 301 will keep its shape, when applied to a less dense surface, allowing flesh to be biased away from the cutting tool.

When this embodiment is used with a target material on a solid surface that is denser than the nib 301, like a piece of cloth or paper on a cutting mat or table, the nib 301 will compress and allow the cutting tool to engage the target surface. The cutting tool will engage a target surface and cut it but it is biased against cutting less dense material like that of the human body. The safety zone 305 is an area that allows the device to be used, without engaging the cutting tool, until a certain set of circumstances are met. These circumstances are application specific allowing many embodiments of this device to be created simply by varying the design, construction and orientation of the nib and cutting tool. Other safety zone 305 designs will be made in such a manner as to allow acceptable characteristics for specific applications and needs.

Another example of the benefit of selecting the nib 301 density and rigidity in combination with the location of the cutting tool 300 uses a very soft nib 301 and a cutting tool protruding from the device. This configuration allows a person to make deep cuts and precisely locate the cutting tool while simultaneously applying a great deal of decorating material. The soft nib will ensure contact with the target material while allowing the cutting tool to cut deeply into the target material. This embodiment would be very useful for creating designs in leather and other such materials.

Another embodiment of the invention uses the configuration of FIG. 43 with a nib 301 that does not wick any material. In this embodiment a safer cutting tool is created. Because the benefits of the nib 301, the benefits of protecting the target materials and the cutting tool, are taken advantage yet the cutting tool is able to engage target material when the safety zone allows it to. This embodiment creates a much safer cutting tool that is easy to use. Embodiments of this device will have a colored nib or will have designs or indicia on the nib to show where the cutting tool is and to help a user orient it.

The description of the nib 301 as being denser and more rigid is designed to convey the concept of a nib 301 that needs specific characteristics to be met before it will yield and or move such that it allows the cutting tool 300 to engage target material. There are many ways this can be done and the above descriptions and embodiments are simply designed to be representative of some of the ways. The composition, design, structure, shape, orientation and location of the nib and the composition, design, structure, shape, orientation and location of cutting tool, themselves and with respect to each other, will yield many useable embodiments of this invention.

Figure 44:
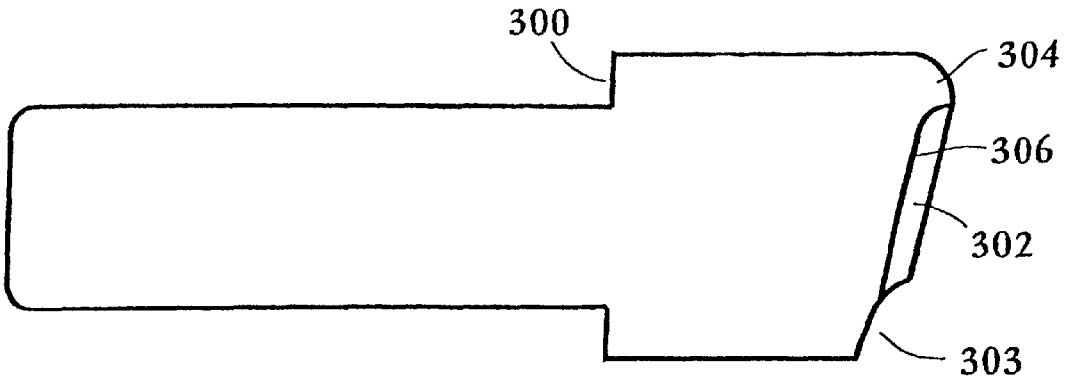
FIG. 44 is a side view of a cutting tool showing depth and safety stops.

FIG. 44 shows the cutting tool of FIG. 43. Cut stop 304 is made to be thick and unable to cut. This is done to require the tool to be at an appropriate angle before it will allow the cutting tool's cutting edge 302 to engage a target material. By varying the shape of the cut stop 304 other embodiments are created that give different advantages to their users. A larger radius rounded cut stop 304 will cause the tool to require a lower angle of attack to begin cutting and a smaller radius rounded cut stop will allow the tool to be used in a more upright position. The position and location of this cut stop 304 makes this embodiment of the cutting tool biased against cutting with a stabbing action. During a stabbing action the rounded cut stop 304 will be the portion of the cutting tool that contacts the target material. Because the cut stop 304 is thick and rounded and without a point it is not able to easily cut thus making the tool safer.

Flat depth stop and guide 303 leads into the cutting tools cutting edge 302 and stops the cutting edge 302 from penetrating below a specific depth set by the height of the depth stop and guide's 303 face in relation to the cutting edge 302. The depth stop and guide 303 also provide tactile feel to the user and helps orient the cutting edge. Users, when they apply enough pressure to the cutting tool to move the blade far enough to allow the depth stop to contact the target material, will feel it bottom out when the depth stop and guide 303 is pressed against the target material. This embodiment uses a depth stop and guide 303 with a filleted lead in to the cutting edge 302 and a shaped point intersecting with the bottom of the cutting edge. The depth stop and guide 303, in other embodiments, will have square, filleted or shaped edges on one or more sides.

Depth stop 306 limits the depth the cutting tool will cut biasing it against cutting deeper than desired. Cutting edge 302 in this embodiment is ground on two sides and in other embodiments it will be ground on at least one. In embodiments using a single ground edge the depth stop 306 will cause the cutting edge to be more particular about how and what it will cut. It will make a safer tool that will only cut when it is pressed to target material in a certain manner. This embodiment uses a dual ground cutting edge and will have the depth stop 306 on each side of the cutting edge allowing it to cut with greater ease and to be less particular. Both embodiments have advantages when used for certain purposes under certain circumstances.

Figure 45:
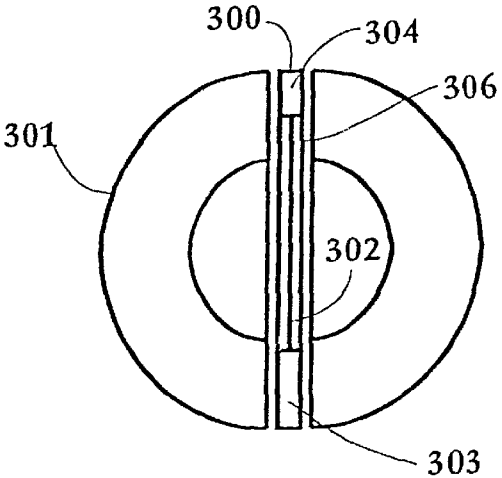
FIG. 45 is a front view of the nib and cutting tool of FIG. 43.

FIG. 45 is a front view of the tool of FIG. 43 having a nib 301 in two halves. Other embodiments use nibs that can be a single piece. And other embodiments use multi-part nibs that have top, bottom, left and right sides. Each of the nibs can, but does not have to, wick decorating or beneficial material.

Figure 46:
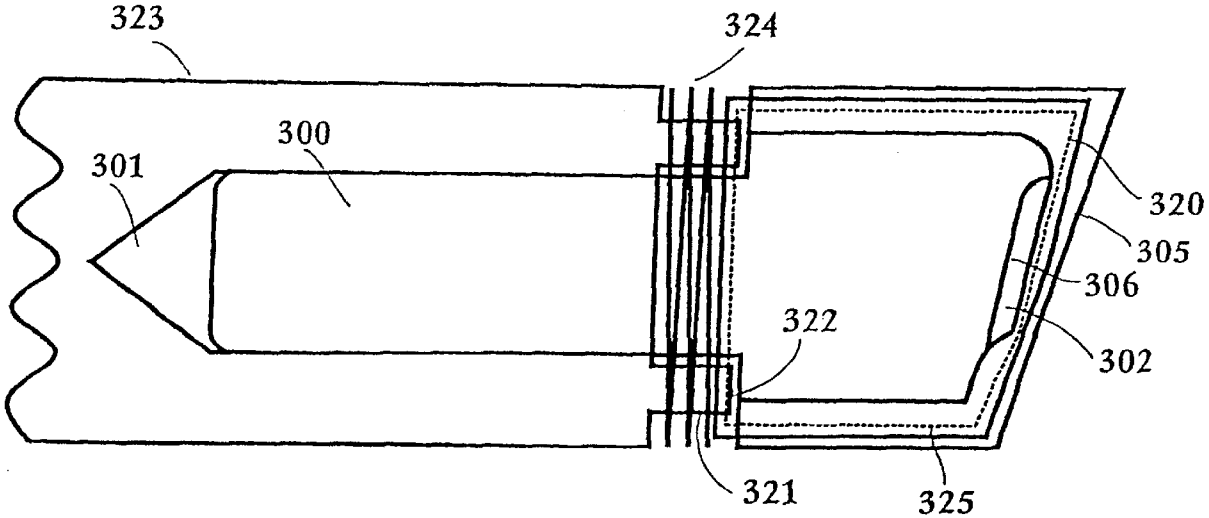
FIG. 46 is a side view of an embodiment of the present invention using a spring biased cutting tool shield.

FIG. 46 shows a side view of an embodiment of the present invention that uses a spring 324 biased cutting tool shield 320. The cutting tool shield 320 rides on the cutting tool shield guides 321, supporting the shield on at least one side, and meshing with the cutting tool shield guide surfaces 325. Case 323 of this embodiment is designed to store decorating material and can also operate without it. When the required minimum pressure is applied to nib 301 it compresses and allows pressure to be applied to the cutting tool shield 320. The cutting tool 300 cannot engage the target material until enough pressure is applied to compress the nib 301 and spring 324. When enough pressure is applied nib 301 and the cutting tool shield 320 move enough to allow the cutting tool 300 to engage a target material. The cutting tool shield 320 is the primary safety feature and the safety zone portion of the nib is the secondary. This allows the device to be safe to use and to maintain a specific required minimum pressure, as set by the spring 324, that must be applied before the cutting tool will be able to engage the target material.

Figure 47:
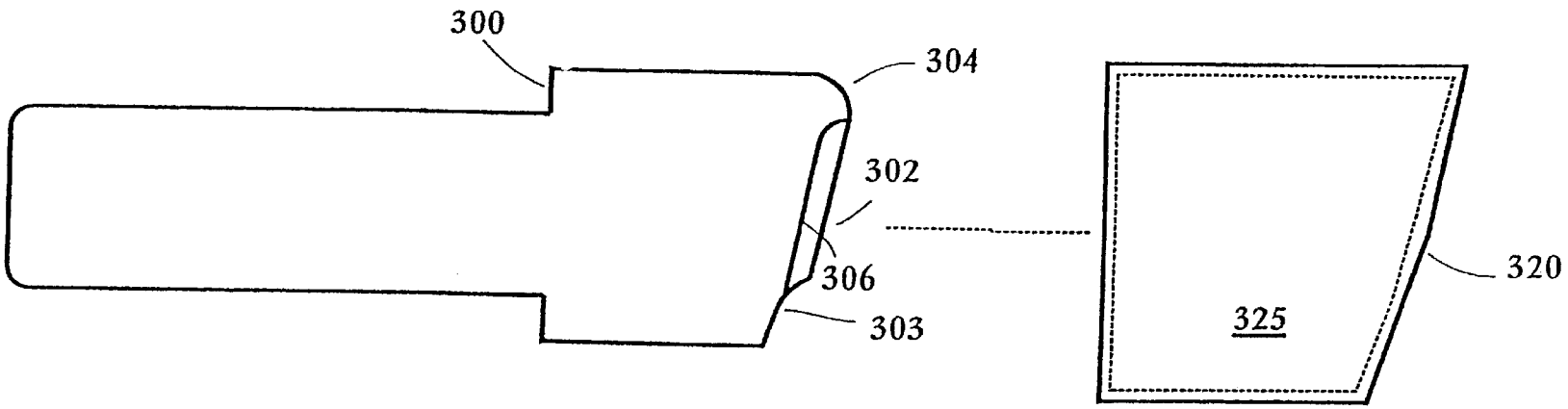
FIG. 47 is an exploded side view of the cutting tool shown in FIG. 46 with depth and safety stop and a pushdown.

FIG. 47 shows a side view of the cutting tool 300 and the cutting tool shield 320 of FIG. 46 and how they are assembled.

Figure 48:
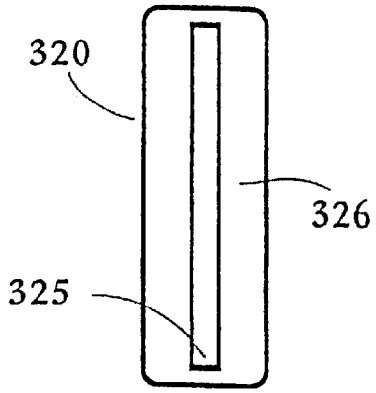
FIG. 48 is a front view of a cutting tool shield.

FIG. 48 is a front view of the cutting tool shield 320 of FIG. 46. Cutting tool shield guide surfaces 325 fit the cutting tool closely and orient the cutting tool shield 320 to the cutting tool. The cutting tool shield guide surfaces 325, in this embodiment, are set centrally within the cutting tool shield 320 as is seen in this front view. Other embodiments use different offsets to create cutting tool shields that take advantage of the extra face surface on one of the sides of the cutting tool. Cutting tool shield face 326 in this embodiment is made to be about 4 times greater than the thickness of the cutting tool. This provides a solid surface that can be run over the target material when the cutting tool is not engaged. It also acts as a spreader that flattens target materials about to be cut making cutting easier. Other embodiments use cutting tool shield faces of different sizes and shapes to gain different advantages based on the specific needs of the task at hand.

Figure 49:
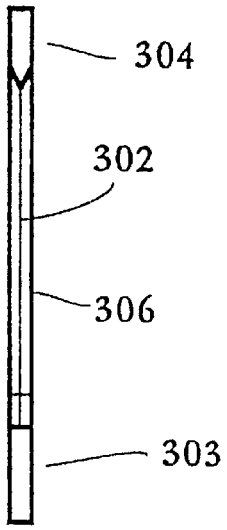
FIG. 49 is a front view of the cutting tool of FIGS. 44 and 47 with depth and safety stops and a pushdown.

FIG. 49 is a front view of the tool 300 shown in FIG. 47.

Figure 50:
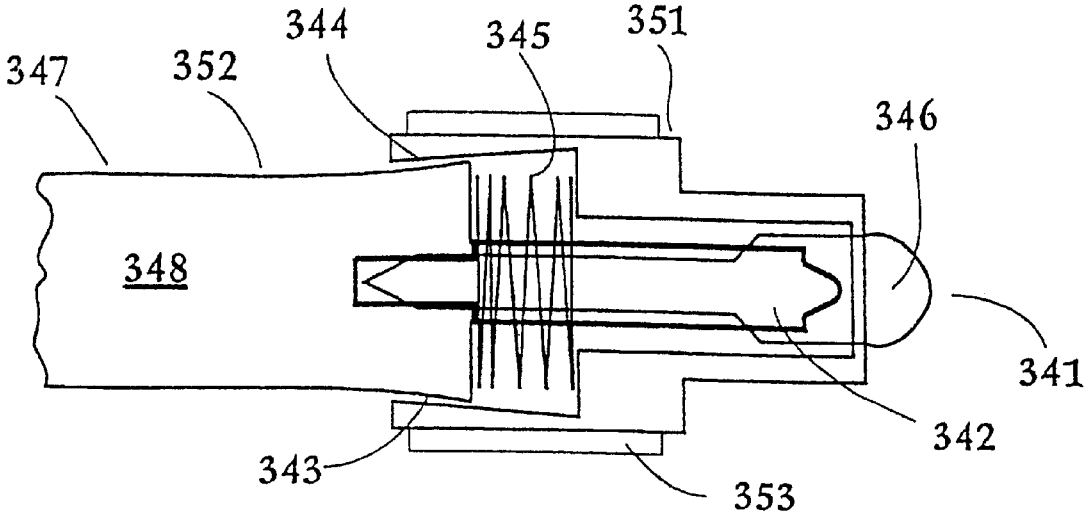
FIG. 50 is a side view of an embodiment of the present invention that uses a spring to bias the cutting edge into the case.

FIG. 50 is a side view of an embodiment of the present invention that uses a spring to bias a cutting tool 342 into a non-cutting position. Nib 346 is held in place by nib holder 344. Case 347 has a decorating or beneficial material storage vessel 348 that when filled allows the device to cut and decorate and when left empty allows the device to cut only. Case retaining surface 343 mates with the nib holder retaining surface 344 and keeps the two parts together in a manner that allows the case 347 to be pushed so that it causes the nib 346 and/or cutting tool 342 to engage a target material. The nib 346 will easily engage a target material. To cause the nib 346 and the cutting tool 342 to engage a target material enough pressure must be applied to compress the spring 345. This causes the cutting tool 342 to move to a position that allows it to engage a target material. In different embodiments different nibs with different density, rigidity, structure and shape are designed to work in cooperation with different springs, the orientation of the two, and distance of the cutting tool to the target material. By adjusting these parameters devices of different attitudes are created. The spring 345 helps to control the minimum required pressure to allow the cutting tool 342 to be in a position to engage at target material.

This embodiment allows the user to select a unique decorate only mode. The user can also easily operate the device as a decorate and cut device. By holding the decorate only finger grip 353 the user can easily and comfortably engage only the nib 346 in the same manner one uses a standard marking device. When holding the decorate only finger grip 353 it is not possible for the user to engage the cutting tool because the spring 345 is biasing it away from the target material. The user can apply as much pressure as they wish without the possibility of engaging the cutting tool. When the user places pressure on the nib holder 351 using the decorate only finger grip 353 they are pushing only the nib 346 to the target material and not the cutting tool 342.

When the user places pressure on the case 347 at the decorate and cut finger grip 352 the user engages the nib 346 and also the nib 346 and cutting tool 342 by simply applying the appropriate pressure.

Because the cutting tool 342 is inserted into the handle 347 it cannot be engaged during use unless the user is operating the device while holding the decorate and cut finger grip 352 of the case 347.

Figure 51:
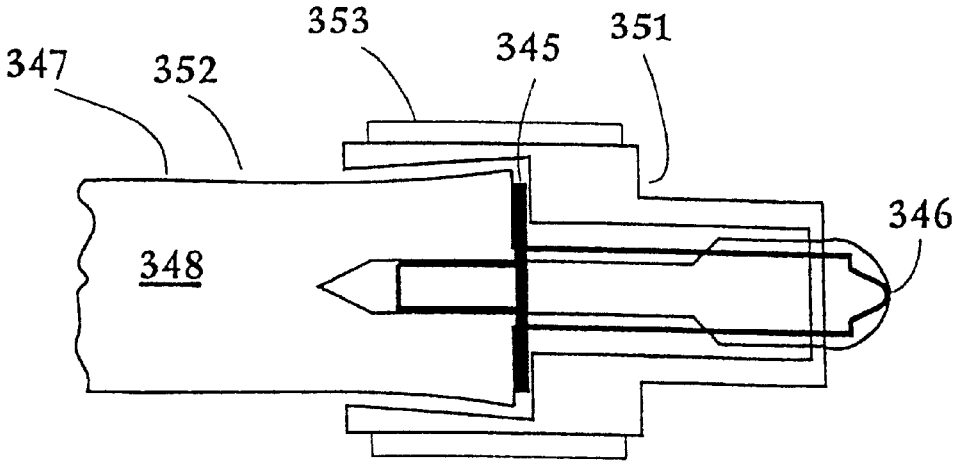
FIG. 51 is a side view of the cutting tool of FIG. 50 with the spring compressed and the cutting tool in a cut position.

FIG. 51 shows the tool of FIG. 50 with its spring 345 compressed. This positions the nib 346 and cutting tool 342 in a position ready to engage a target material. Other embodiments allow the user to set the device to free-movement like in this embodiment and also have a locked spring mode in which the device will operate with the spring set at uncompressed, fully compressed or partially compressed. These embodiments give the user access to different features and benefits of different modes.

Figure 52:
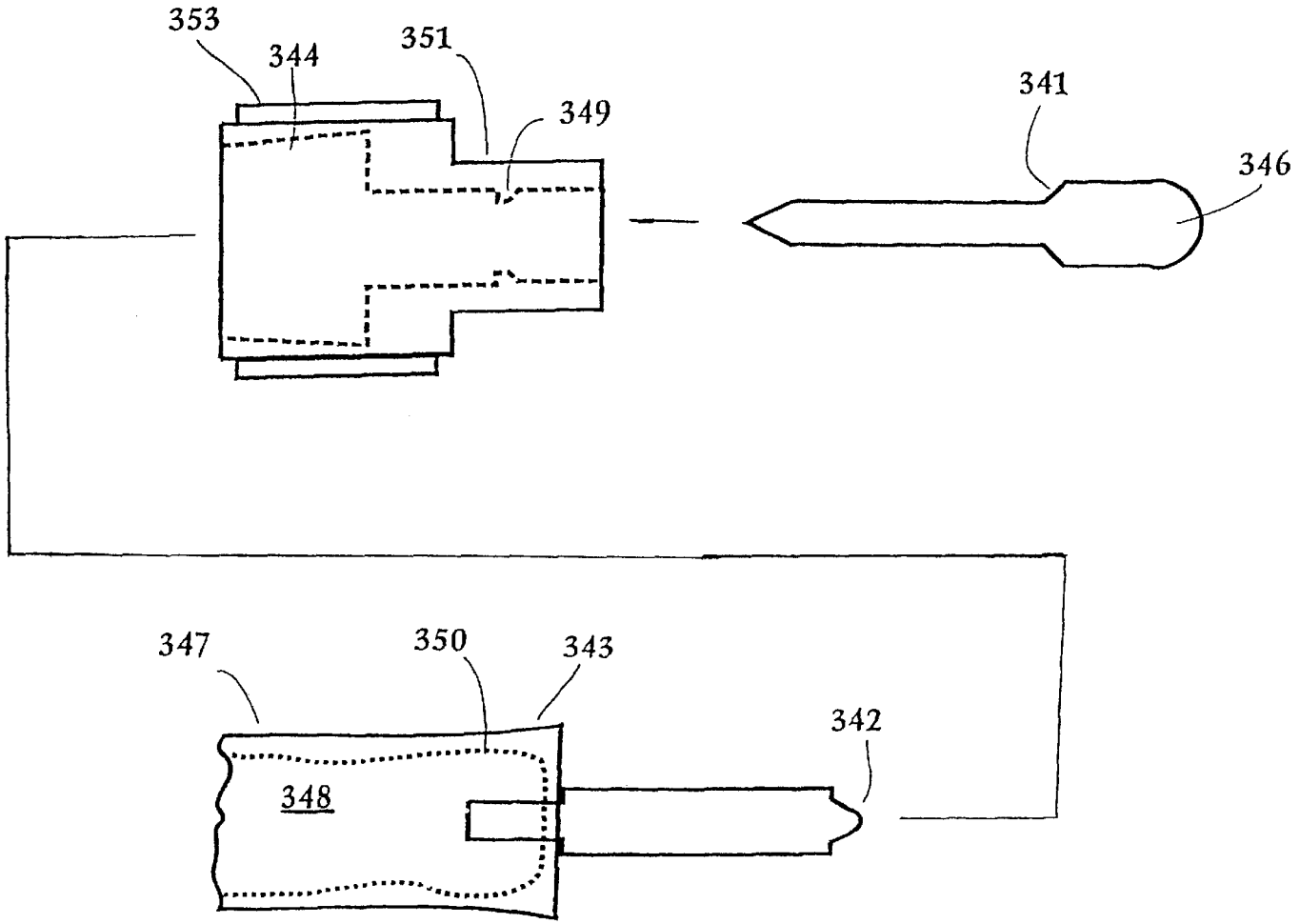
FIG. 52 is an exploded side view of the nib of the tool shown in FIG. 50.

FIG. 52 shows a side view of the tool of FIG. 50. This nib is made in two parts that sit on each side of the cutting tool 342 and is long enough to reach the decorating and or beneficial material storage container 348. Nib support shoulder 341 meshes with the nib stop 349 and keeps the nib from being pushed into the device by the pressure applied during use.

Nib holder 351 with nib stop 349 keeps nib 346 from being pushed into the case when pressure is applied. Decorate only finger grip 353 allows a user to easily operate this embodiment in a decorate only mode. The nib holder retaining surface 344 is shaped to allow the nib holder 351 to move freely and also to keep an airtight seal protecting the nib 346 from drying out. Other embodiments use o-rings, gaskets or other devices to keep the airtight seal.

Cutting tool 342 is inserted into case 347. The decorating and beneficial material storage container 348 is made of felt and wrapped in cellophane 350. The decorating and beneficial material storage container 348 is a common practice in many marking devices of today. Other embodiments use liquid, gel, wax, glue, chalk, dye, water, acid, etching solution, ink, food coloring or other types of decorating or advantageous material. Retaining surface 343 is shaped to hold the nib holder in such a manner as to allow it to freely slide so the cutting tool 342 can engage the target material while it also creates an airtight seal to protect the nib from drying out.

Figure 53:
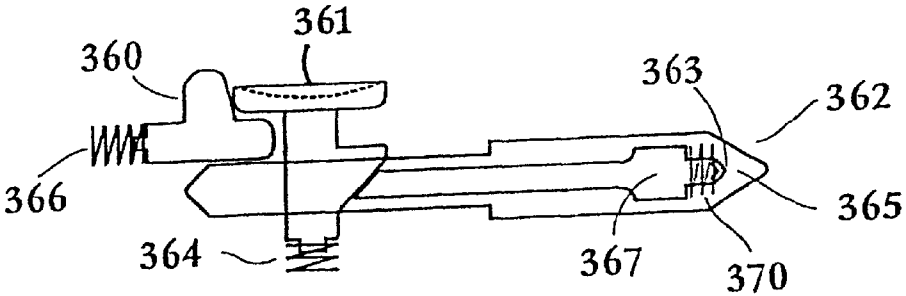
FIG. 53 is a side view of an embodiment of the present invention that uses a cutting tool safety lock and requires pressing of a button to engage the cutting tool.
Figure 54:
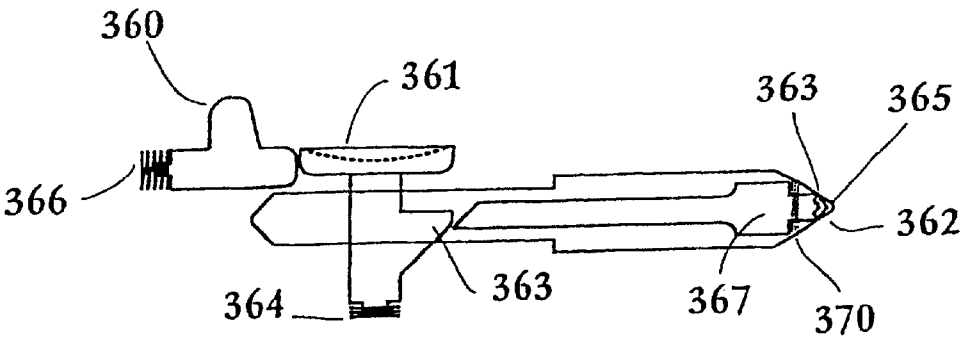
FIG. 54 is a side view of the tool shown in FIG. 53 with the lock open and allowing the button to be pressed thus engaging the cutting tool.
Figure 55:
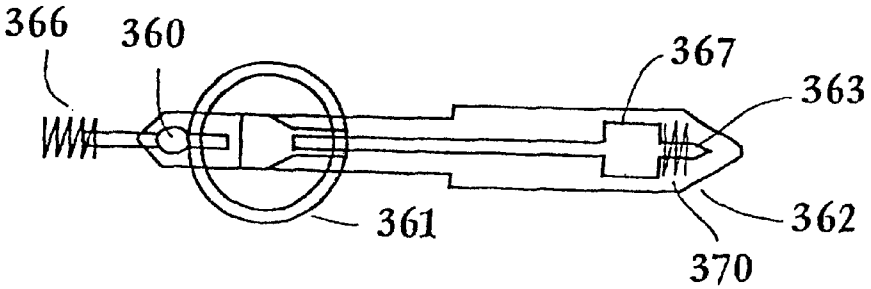
FIG. 55 is a top view of the tool shown in FIG. 53.

FIGS. 53, 54, and 55 show an embodiment of the present invention that uses a lock that cooperates with a button to make a device that will operate as a decorating device and only decorate until specifically engaged as a decorating and cutting device.

FIG. 53 is a side view of an embodiment of the present invention that uses a cutting tool lock 360 biased in the locking position by spring 366 to hold a cutting tool and cutting tool activation button 361 in a locked position. This embodiment works as follows. A user pulls back the cutting tool lock 360 which compresses spring 366. This allows the user to press the cutting tool activation button 361. As the cutting tool activation button 361 moves down its cutting tool activating surface 363 pushes the cutting tool 367 forward. The cutting tool 367 is pushed relative to the pressure applied to the cutting tool activation button 361. Spring 364 is used to bias the cutting tool activation button 361 to the non-engaged position. Nib 362 has a safety zone 365 designed to bias the device to be used in a safe manner and to protect surfaces and the cutting tool 367 even when it is engaged. This embodiment uses a dual-side ground dual-cutting edge 371 that allows it to cut at many angles and using push, pull and poke cuts. Spring 370 bias cutting tool 367 to a non-cutting position.

The cutting tool 367 depth stop and guide orients the cutting tool centrally in the nib 362 and it also acts as a depth stop. The flat surface of the cutting tool 367 depth stop and guide also keeps the cutting tool centrally located inside the nib 362.

FIG. 54 shows a side view of the tool of FIG. 53 with the cutting tool lock 360 disengaged and cutting tool activation button 361 fully engaged and the cutting tool 367 ready to engage a target material. In this embodiment the nib 362 has been designed to have a safety zone 365 that keeps the cutting tool away from all surfaces until it is intentionally engaged and more than the required minimum pressure is applied to the invention. In this embodiment the nib 362 is designed to wick material. In other embodiments the nib 362 is simply used to protect surfaces from the cutting tool by filling the safety zone 365 with a material of a specific density, rigidity, design and composition.

FIG. 55 shows a top view of the tool of FIG. 53. Cutting tool 367 guide and stop is designed to limit the depth of cut and to also provide enough surface to allow the cutting tool 367 to self-center and to move, in the nib 362, in a precise and repeatable manner. In this embodiment the cutting tool will always self-orient to a position that is comfortably aligned with the activation button 361. Other embodiments have cutting tools that rotate and still others will have cutting tools that swivel. These additional embodiments also take advantage of a selectively engage-able cutting tool using an activation button and an optional locking mechanism.

Figure 56:
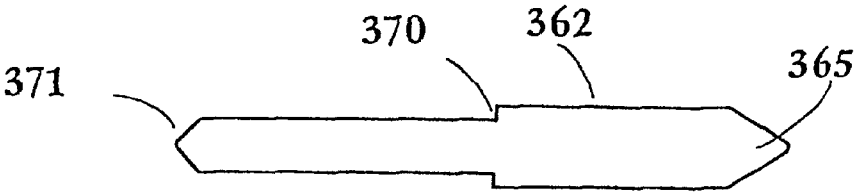
FIG. 56 is a side view of the nib shown in FIG. 53.

FIG. 56 shows a side view of the nib 362 with a safety zone 365, an area that is used as a point where wicking can start 371, in embodiments that require wicking, and a shoulder 370 designed to keep the nib 362 from being pushed into the case when pressure is applied.

Figure 57:
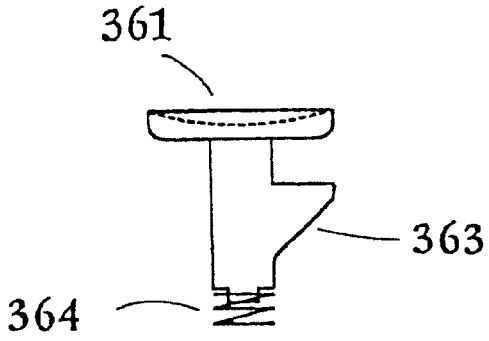
FIG. 57 is a side view of the cutting tool activation button shown in FIG. 53.

FIG. 57 is a side view of the cutting tool activation button 361 with spring 364 to bias the assembly to a non-engaged position. Cutting tool activating surface 363 works as an inclined plane to move the cutting tool to an engaged position and against spring 370.

Figure 58:
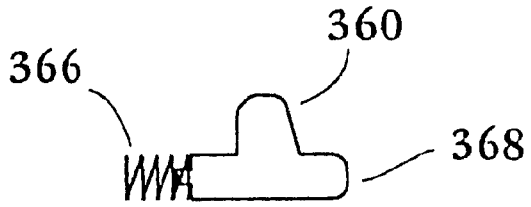
FIG. 58 is a side view of the cutting tool lock shown in FIG. 53.

FIG. 58 is a side view of the cutting tool lock 360 with spring 366 and locking member 368. The locking member 368 is used to stop the cutting tool activation button 361 from engaging the cutting tool until the user actually wishes to engaged the cutting tool. This protects the cutting tool and other surfaces from being unintentionally cut, scratched, poked or damaged.

Figure 59:
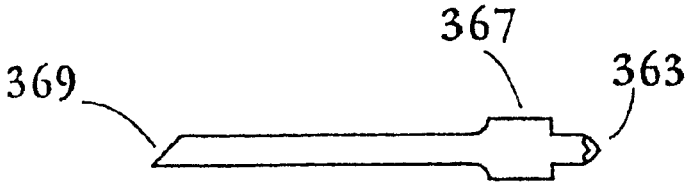
FIG. 59 is a side view of the cutting tool shown in FIG. 53.

FIG. 59 shows a side view of the cutting tool 367 with activation surface 369 cutting tool stop and glide shoulder and multi-direction cutting tool 371 that can be used to cut on at least one side.

Figure 60:
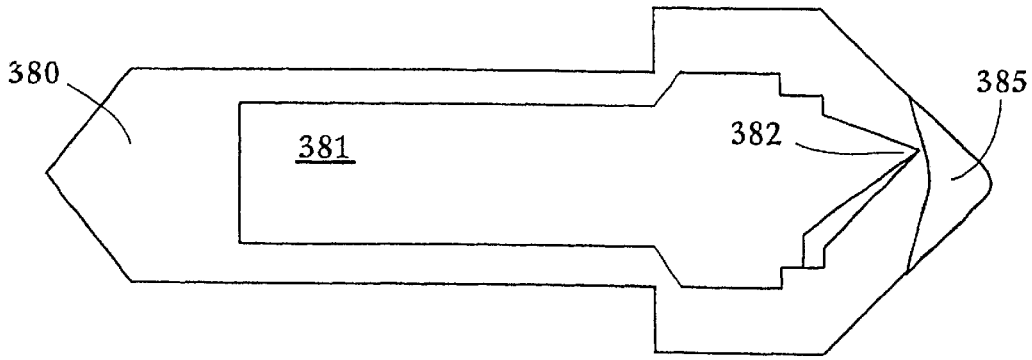
FIG. 60 is a side view of an embodiment of the present cutting tool and nib that locates the cutting tools cutting edge point toward the top of the nib.

FIG. 60 shows a side view of an embodiment of the present invention with a cutting tool 381 having a cutting edge and cutting point 382 set toward the top of the nib 380. This allows a person to cut and decorate leaving only a small amount of decorating material where the cut begins. It also has an additional advantage of requiring a higher angle of attack to engage the cutting tool which means a person can use the marker, more easily, as a standard marker. The user will not be able to cut or engage target material, with the cutting tool, unless they raise the use angle of the cutting tool 381 and nib 380 so that the cutting tool point 382 is at an angle that allows it to contact the target material. This embodiment will be more easily used as a marker only and will require pressure to be exerted, at a higher angle, before it will cut. This embodiment uses a stationary cutting tool. Other embodiments use rotating and or swiveling cutting tools.

Figure 61:
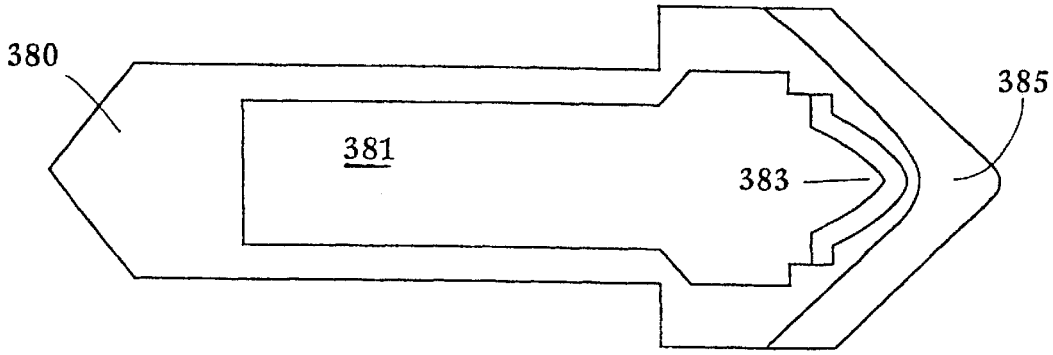
FIG. 61 is a side view of an embodiment of the present cutting tool and nib that locates the cutting tools cutting edge point toward the center of the nib and uses a cutting tool shape that allows for cutting to take place in more than one direction.

FIG. 61 is a side view of a cutting tool 386 with a centrally biased cutting edge 383 and a nib 380 with safety zone 385. This allows a user to cut with the device using one of two cutting tool edges and at a variety of angles. When one side becomes dull the other side can be used. This extends the devices useful life. The location of the cutting edge and cutting point 383 toward the center of the nib 380 creates a device that decorates and cuts when used at a moderate and fairly normal writing angle and also at a higher angle and also with a pushing motion that will pierce the target material. This embodiment uses a stationary cutting tool. Other embodiments use rotating and or swiveling cutting tools.

Figure 62:
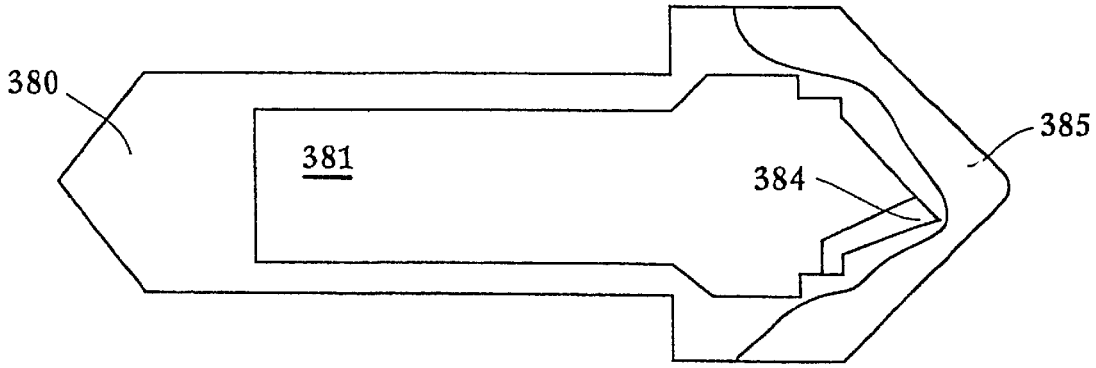
FIG. 62 is a side view of an embodiment of the present cutting tool and nib that locates the cutting tools cutting edge point toward the bottom of the nib.

FIG. 62 is a side view of a cutting tool 387 and nib 380 combination with safety zone 385. The cutting surface and cutting point 384 are oriented toward the bottom of the nib. This arrangement makes it easy to cut and decorate using an average writing instrument angle. An advantage of this configuration is that when used upside-down, with the cutting tool facing away from the target material, it is practically impossible to cut the target material while marking or decorating at a comfortable angel. When used in decorate and cut mode this device will easily cut and decorate. This embodiment uses a stationary cutting tool. Other embodiments use rotating and or swiveling cutting tools.

Figure 63:
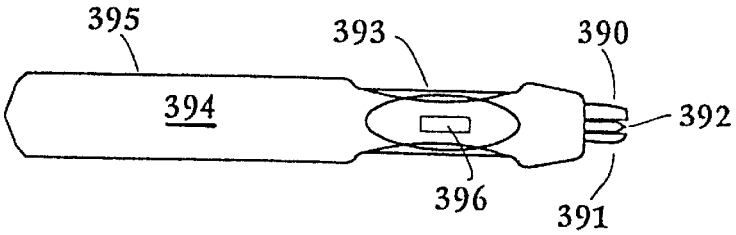
FIG. 63 is a top view of an embodiment of the present tool having multiple decorating and or cutting features.

FIG. 63 shows a top view of an embodiment of the present invention that uses the top, bottom, and outside surfaces of each of its two nibs 390 and 391 and two sides of the cutting and spacer tool 392. In this configuration a user can generate 4 major functions and numerous minor functions. The case 395 has 4 finger grips 393 that, when pointing in a specific direction, orient the user, with tactile and visual indications 396 and 397. Only two tactile and visual indicators are shown 396 and 397. In this embodiment there are four, one on each side, and each tells the user which function they will be engaging. The tactile and visual indicator 396, when pointing up (parallel to and on the opposing side of the device away from the target material) tells the user they will be cutting and decorating. The tactile and visual indicator 397 tells the user, when pointing up (parallel to and on the opposing side of the device away from the target material), that the user will be using the broad surface of the nib 390.

Figure 64:
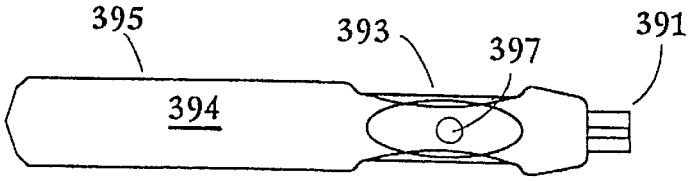
FIG. 64 is a side view of the tool shown in FIG. 63.

FIG. 64 shows a top view of the tool of FIG. 63 oriented to use the broad nib. Each of the nibs in this embodiment is fed, via wicking, from the material storage vessel 394. Other embodiments use separate storage vessels to allow each nib to use a different decorating and or beneficial material.

Figure 65:
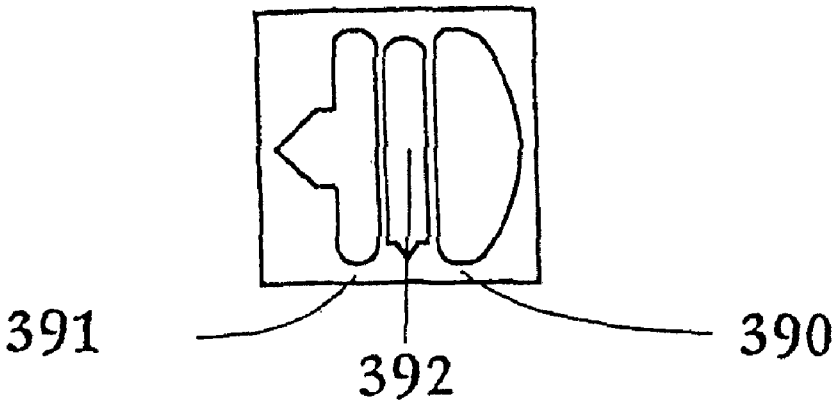
FIG. 65 is a front view of the tool shown in FIG. 63 in the cut and decorate position.
Figure 66:
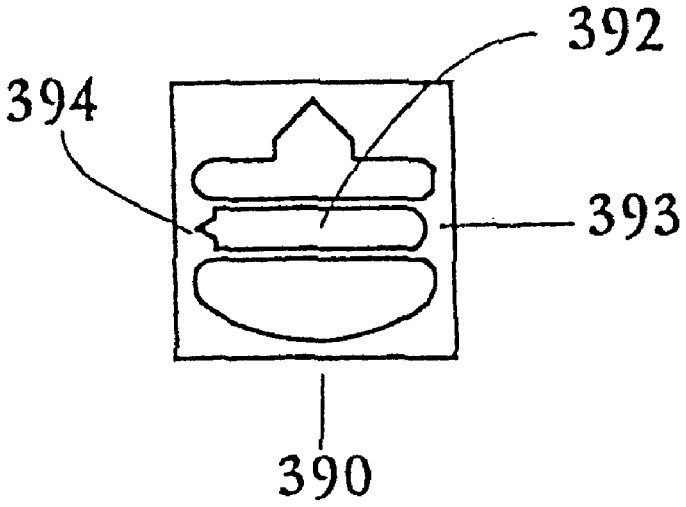
FIG. 66 is a front view of the tool shown in FIG. 63 in the thick/heavy line decorate position.
Figure 67:
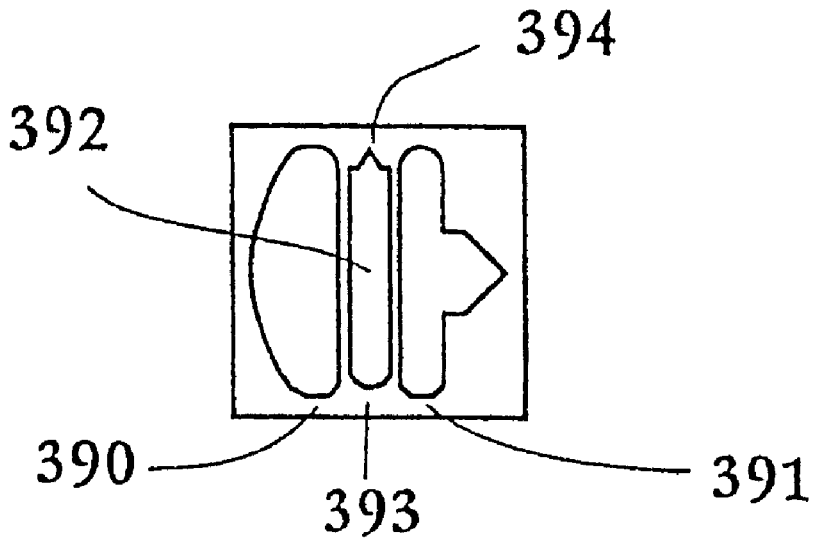
FIG. 67 is a front view of the tool shown in FIG. 63 in the dual-drawing-medium-line decorate position.
Figure 68:
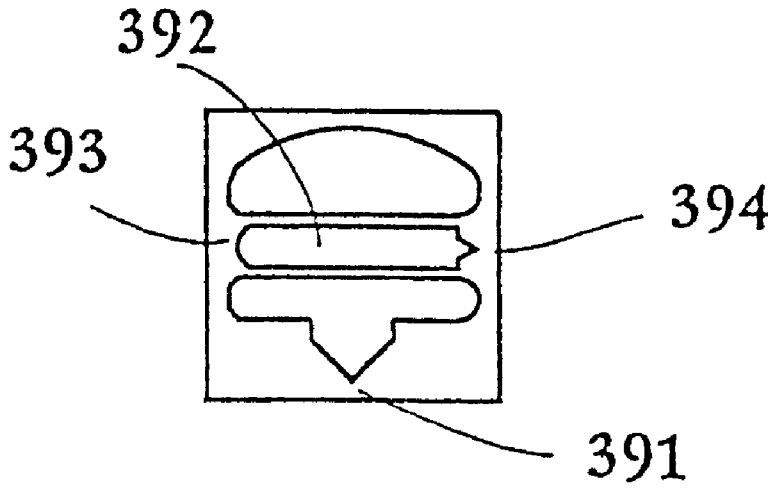
FIG. 68 is a front view of the tool shown in FIG. 63 in the thin-line decorate position.

FIGS. 65–68 show the major functions possible in the embodiments shown in FIG. 63. FIG. 65 cut and decorate, FIG. 66 heavy line decoration, FIG. 67 dual line decoration without cutting, FIG. 68 fine line decorating. Minor functions can be obtained by using the device with the nibs oriented at angles other than perpendicular to the target material. The color, size, texture, shape and feel of the case is designed to allow a user to access the major and minor functions of the devices with ease.

Figure 69:
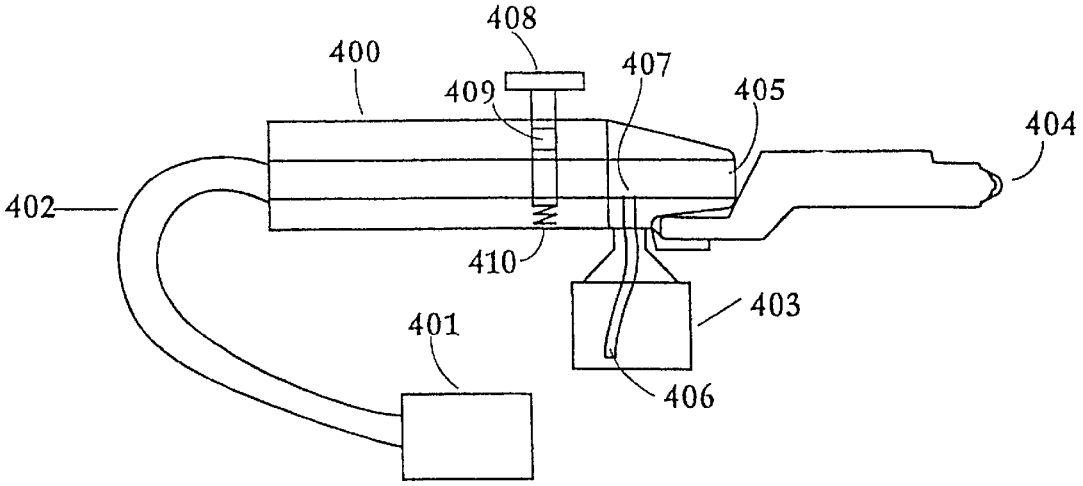
FIG. 69 is a side view of an embodiment of the present invention that decorates with a gas driven decorating device and uses a cutting tool to cut.

FIG. 69 shows an embodiment of the present invention that sprays/shoots decorating or advantageous material toward a target surface. Feed tube 406 draws decorating material from the decorating material storage vessel 403 when gas from a gas source 401 moves through gas supply tube 402 into handle body 400 past valve 409, when it is open. The valve 409 is operated by stream activation button 408. As the gas passes past the decorating material feed tube exit 407 it draws decorating material up the feed tube 406, mixes it with the gas, which is then ejected from the spray nozzle 405 past the cutting tool 404 and onto a target material. The user can decorate by pressing stream activation button 408 and can also cut by engaging the cutting tool 404 to the target material. When this is done simultaneously the user will be cutting and decorating.

Figure 70:
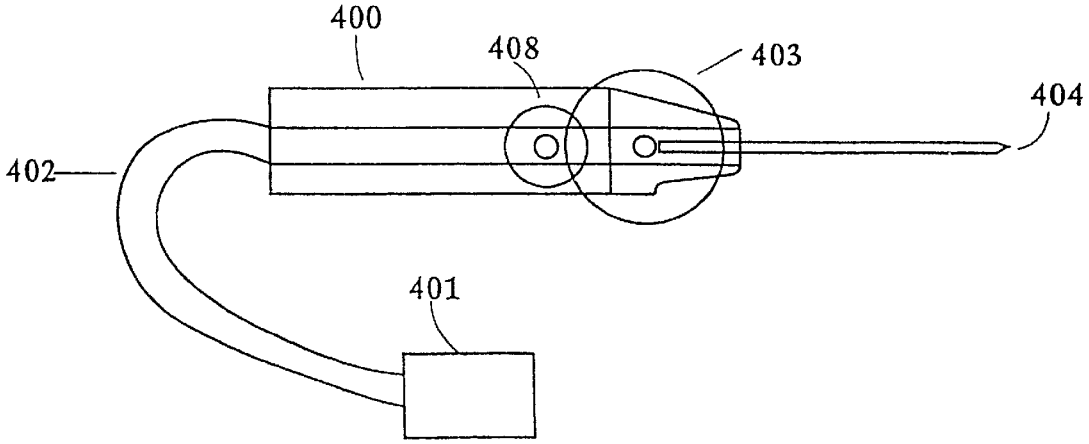
FIG. 70 is a top view of the tool shown in FIG. 69.

FIG. 70 shows a top view of the tool of FIG. 69. Other embodiments use marking devices as decorating material supply vessels with a compatible gas supply and a cutting tool instead of the configuration shown. This will allow markers to replace the material storage vessel 403.

Figure 71:
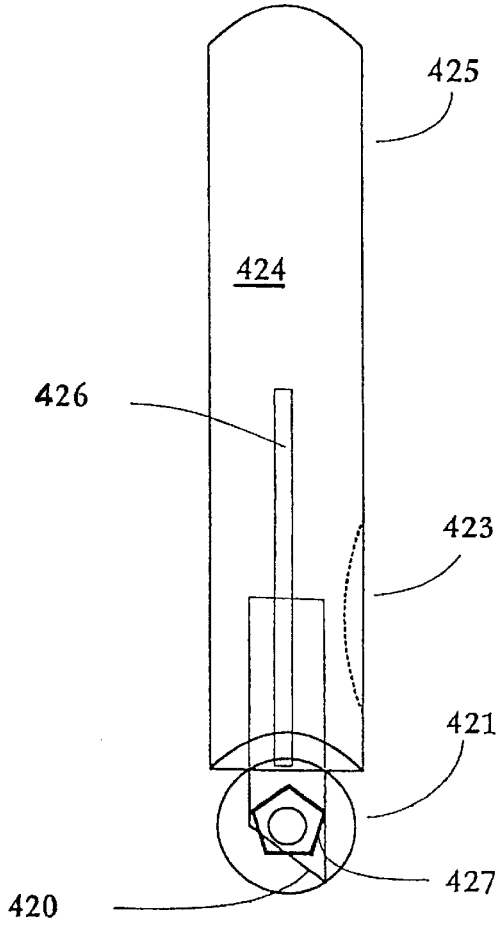
FIG. 71 is a side view of an embodiment of the present invention that uses a stationary cutting tool and a rotating decorating device.

FIG. 71 shows a side view of a tool with a rotating decorating nib 421 fed via wicking from feed wick 426. Decorating material is stored in the decorating material storage vessel 424 housed in case 425. This embodiment uses a stationary cutting tool 420 that cooperates with the nib to cut and decorate. The rotating decorating nib 421 in this embodiment is a nib that produces a single color wide-line. Other embodiments use a rolling rubber stamp or shaped nib to produce an interesting design next to the cut edge. Other embodiments allow the cutting tool and or the nib to be removed or at least disengaged so as to only allow only cutting or decorating. The thumb grip 423 allows a user to easily orient the device for use. The shaft 422 supports the rotating decorating nib 421 by attaching it to the stationary cutting tool 420. The stationary cutting tool 420 acts as a cutting tool and a support for the shaft 422 and rotating decorating Nib 421. Other embodiments use multiple cutting tools and or multiple nibs. Nut 427 attaches the rotating decorating nib 421 to shaft 422 and bearing 428 assists the rotating decorating nib 421 spinning during use. Other embodiments use different configurations of rotating decorating nibs 421 and stationary cutting tool 420 to create different advantages.

Figure 72:
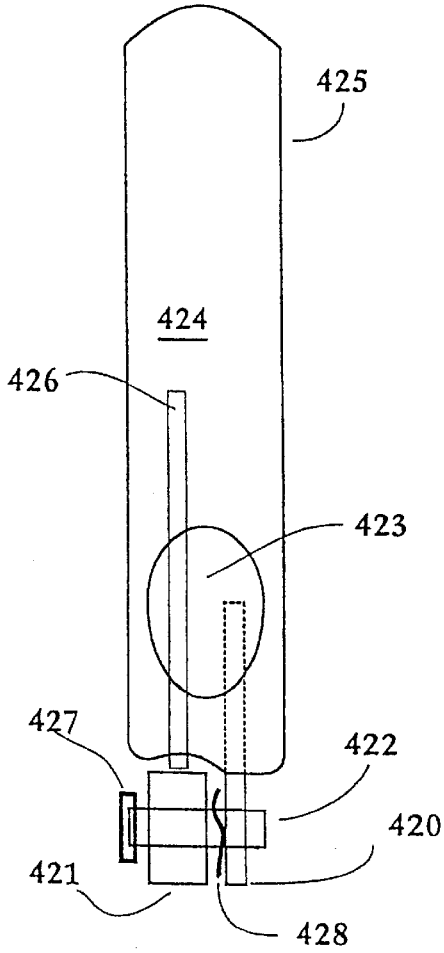
FIG. 72 is a front view of the tool shown in FIG. 71.

FIG. 72 shows a front view of the tool of FIG. 71.

Figure 73:
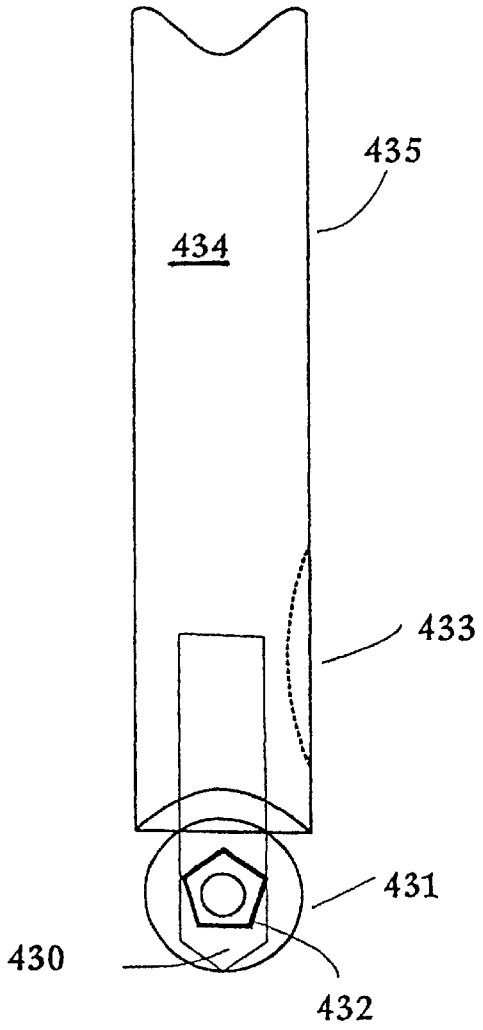
FIG. 73 is a side view of an embodiment of the present invention that uses a rotating cutting tool and a stationary decorating nib.

FIG. 73 shows an embodiment of the present invention using a rotating cutting tool 431 and a stationary decorating nib 430. The nib 430 and rotating cutting tool 431 are held via support shaft 437. Decorating material storage vessel 434 is housed in case 435. Thumb grip 433 orients the user and helps to maintain a firm grip while the device is being used. Bearing 438 allows the rotating cutting tool 431 to rotate freely during use. Nut 432 holds the rotating cutting tool 431 on the shaft.

Figure 74:
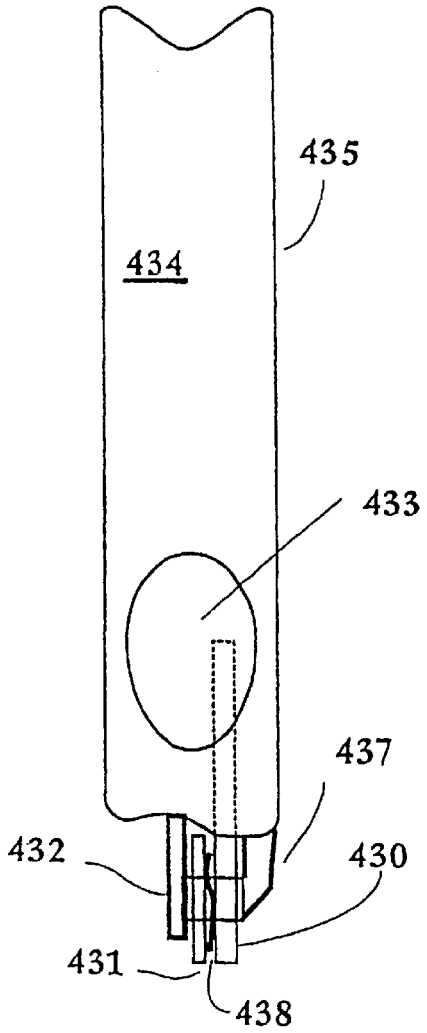
FIG. 74 is a front view of the tool shown in FIG. 73.

FIG. 74 is a front view of the tool shown in FIG. 73.

Figure 75:
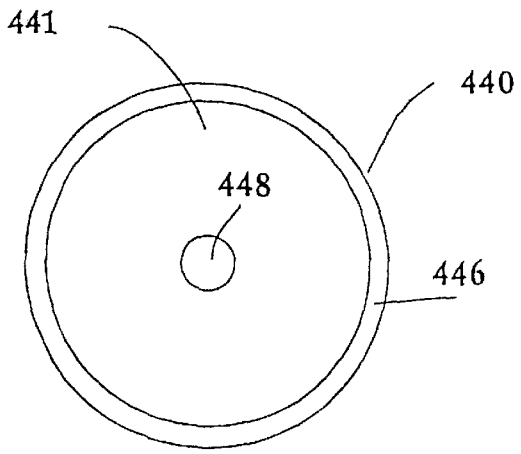
FIG. 75 is a top view of an embodiment of the present invention that uses an orbicular round cutting implement with a nib designed to bias the cutting tool away from objects that should not be cut and to protect the cutting tool.

FIG. 75 shows a rotating cutting tool 441 sandwiched between two rotating nibs 440 which create a safety zone 446 around the entire perimeter of the rotating cutting tool 441. A centrally located shaft hole 448 allows the device to be attached to a shaft and used as a safer rotating cutter.

Figure 76:
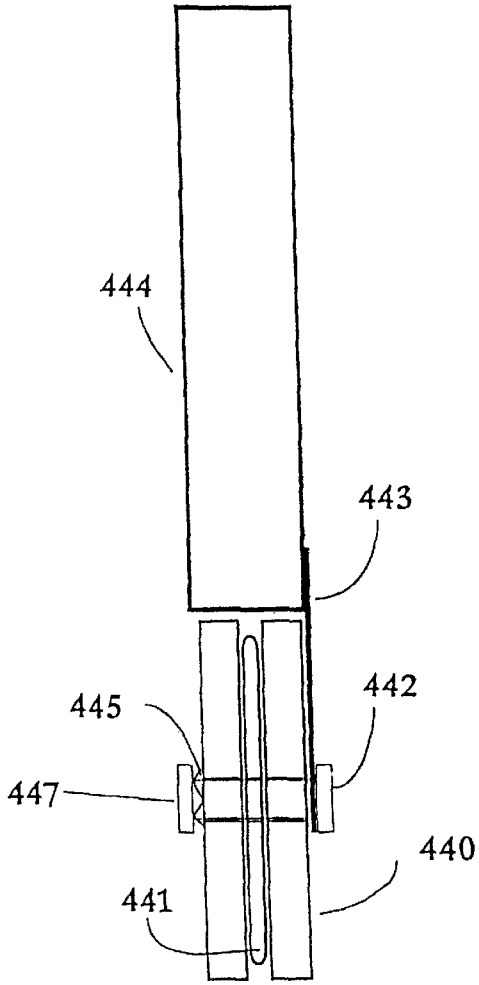
FIG. 76 shows an embodiment of the present invention using the tool shown in FIG. 75 without decorating capabilities but taking advantage of the protective nature of the nib.

FIG. 76 shows an embodiment of the tool shown in FIG. 75. A rotating cutting tool 441 is sandwiched between two rotating nibs 440. A handle 444 is attached to support 443 that uses a bolt 442 to act as a shaft and hold the rotating nibs 440 and sandwiched rotating cutting tool 441.

Bolt 442 holds the two rotating nibs 440 with the sandwiched rotating cutting tool 441 and wave spring 445 using a nut 447. The wave spring 445 allows one to adjust the tension squeezing the rotating cutting tool 441 and rotating nibs 440. The rotating nibs 440 are here to provide a safety zone 446 protecting material from accidentally coming in contact with the cutting tool. This embodiment does not wick any decorating material to the rotating nibs 440. The purpose of this invention is to create a safer rotary cutter. Other embodiments use different support structures with multiple supports and even decorating nibs with designs on them and shaped rotating cutting tools.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A decorating and cutting device for use with a target material comprising:

a housing;

a cutting blade having first and second ends, said first end being attached to said housing and said second end including a cutting edge for creating a cut in the target material, the cut having an edge;

a decorating material dispenser having first and second ends, said first end being attached to said housing and said second end adapted to dispense decorating material onto the target material adjacent the cut in an area extending along the cut and from about the edge of the cut to a selected width;

means for biasing said cutting blade; and said cutting blade cutting edge being disposed adjacent said dispenser, such that cutting of the target material by said cutting edge and dispensing of decorating material onto the target material in the area occur at about the same time.

2. The device of claim 1 and further including:

a decorating material storage area disposed within said housing and in communication with said first end of said decorating material dispenser.

3. The device of claim 1 and further including means for biasing said cutting edge and said second end of said dispenser, such that said cutting edge and said second end of said dispenser extend beyond said housing.

4. The device of claim 1 and further including means for moving said cutting edge between a first position within said housing and a second position extended beyond said housing.

5. The device of claim 1 and further including means for moving said second end of said dispenser between a first position within said housing and a second position extended beyond said housing.

6. The device of claim 1 wherein said housing including a shoulder adapted to engage a template.

7. The device of claim 1 and further including means for rotating said blade within said housing.

8. The device of claim 1 and further including means for rotating said dispenser within said housing.

9. The device of claim 1 wherein said housing includes roller bearings adjacent said cutting edge.

10. The device of claim 1 wherein said housing includes a spring for biasing said cutting edge and said second end of said dispenser.

* * * * *